United States Patent [19]

Inoue et al.

[11] Patent Number: 4,789,627

[45] Date of Patent: Dec. 6, 1988

[54] METHOD FOR FORMING DIRECT POSITIVE COLOR IMAGES

[75] Inventors: Noriyuki Inoue; Tatsuo Heki; Shinji Ueda, all of Minami-ashigara, Japan

[73] Assignee: Fuji Photo Film Co., Ltd., Minami-ashigara, Japan

[21] Appl. No.: 66,049

[22] Filed: Jun. 23, 1987

[30] Foreign Application Priority Data

Jul. 2, 1906 [JP] . Japan ..... 61-154156
Jun. 25, 1986 [JP] Japan ..... 61-149085

[51] Int. Cl.[4] ..... G03C 5/24

[52] U.S. Cl. ..... 430/406; 430/409; 430/410; 430/445; 430/547; 430/607; 430/611

[58] Field of Search ..... 430/547, 217, 406, 409, 430/410, 411, 445, 489, 611, 607

[56] References Cited

U.S. PATENT DOCUMENTS

| | | | |
|---|---|---|---|
| 4,094,683 | 6/1978 | Tsujino et al. | 96/95 |
| 4,115,122 | 9/1978 | Adachi et al. | 96/76 |
| 4,245,037 | 1/1981 | Tsujino et al. | 430/559 |
| 4,255,511 | 3/1981 | Hirano et al. | 430/217 |
| 4,264,721 | 4/1981 | Shimano et al. | 430/611 |
| 4,294,919 | 10/1981 | Tsujino et al. | 430/559 |
| 4,324,855 | 4/1982 | Oishi et al. | 430/378 |
| 4,358,528 | 11/1982 | Takagi et al. | 430/251 |
| 4,374,923 | 2/1983 | Hirano et al. | 430/410 |
| 4,395,478 | 7/1983 | Hoyen | 430/547 |
| 4,444,871 | 4/1984 | Miyaoka et al. | 430/378 |
| 4,451,561 | 5/1984 | Hirabayashi et al. | 430/611 |
| 4,471,044 | 9/1984 | Parton et al. | 430/217 |
| 4,526,861 | 7/1985 | Ichijima et al. | 430/385 |
| 4,540,655 | 9/1985 | Takagi et al. | 430/410 |
| 4,590,155 | 5/1986 | Klotzer | 430/376 |
| 4,636,457 | 1/1987 | Valbusa et al. | 430/375 |

FOREIGN PATENT DOCUMENTS

| | | |
|---|---|---|
| 3313394 | 10/1983 | Fed. Rep. of Germany . |
| 3313763 | 10/1983 | Fed. Rep. of Germany . |
| 55-151635 | 11/1980 | Japan . |
| 58-178345 | 10/1983 | Japan . |
| 58-181040 | 10/1983 | Japan . |
| 61-134513 | 6/1986 | Japan . |
| 61-136949 | 6/1986 | Japan . |
| 2012443 | 7/1979 | United Kingdom . |

*Primary Examiner*—Paul R. Michl
*Assistant Examiner*—Patrick A. Doody
*Attorney, Agent, or Firm*—Burns, Doane, Swecker & Mathis

[57] ABSTRACT

In a method for forming a direct positive color image which comprises image-wise exposing to light a light-sensitive material comprising a support having provided thereon at least one photographic emulsion layer contaiing unfogged internal latent image type silver halide grains and a color image-forming coupler; developing the light-sensitive material with a surface developing solution containing an aromatic primary amine type color developing agent in the presence of a nucleating agent and/or fogging exposure; bleaching and fixing the resulting material to form the direct positive color image, the improvement is characterized in that the developing solution has a pH of 11.5 or less and does not substantially contain benzyl alcohol; the color coupler is a compound which forms or releases a substantially non-diffusive dye by oxidation coupling with a developing agent, and the internal latent image type silver halide grains have a particular core/shell structure.

According to the method, a direct positive color image having a high maximum color density and a low minimum image density can be obtained in a short time.

15 Claims, No Drawings

METHOD FOR FORMING DIRECT POSITIVE COLOR IMAGES

BACKGROUND OF THE INVENTION

1. Field of the Invention

The present invention relates to a method for forming an image, where a direct positive color image is obtained by image-wise exposing direct positive silver halide photographic light-sensitive materials and by subjecting the materials to a color developing process in the presence of a nucleating agent and/or fogging exposure.

2. Description of the Prior Art

Photographic methods whereby a direct positive color image is obtained without necessitating a reversal processing step or negative film have well been known.

Methods used for forming a positive image using direct positive silver halide photographic light-sensitive materials which methods have hitherto been known may mainly be classified into two types taking practical usefulness into account except for special methods therefor.

One type is a method where a direct positive image is obtained after development by using prefogged silver halide emulsions and by destroying fog nuclei (latent image) in the exposed area utilizing solarization, Harschel effects and the like.

The other type is a method where a direct positive image is obtained by using unfogged internal latent image type silver halide emulsions and by image-wise exposing the emulsions and then conducting surface development after or while conducting fogging process. In the foregoing, the internal latent image type silver halide photographic emulsion means such a type of silver halide photographic emulsion having light-sensitive specks mainly inside the silver halide grains that latent images are mainly formed inside the grains by exposure.

The latter type methods give a positive image in a high sensitivity in general and thus are fit for uses where high sensitivity is required. The present invention relates to the latter type methods.

Various techniques have hitherto been known in this technical field. Main such techniques are disclosed, for example, in each specification of U.S. Pat. Nos. 2,592,250, 2,466,957, 2,497,875, 2,588,982, 3,317,322, 3,761,266, 3,761,276 and 3,796,577, and U.K. Pat. Nos. 1,151,363, 1,150,553 and 1,011,062.

Photographic light-sensitive materials of relatively high sensitivity as direct positive type can be prepared by using these known methods.

Further, the mechanism of direct positive image formation is disclosed in detail, for example, in T. H. James, The Theory of The Photographic Process vol. 4, chapter 7, pages 182 to 193, U.S. Pat. No. 3,761,276 and the like. According to the disclosures, it is believed that fog nuclei are formed selectively on the surface of the silver halide grains of unexposed areas based on a surface desensitizing action because of internal latent images (positive hole) formed by the first image-wise exposure, and then a photographic image (direct positive image) is formed on the unexposed areas by conducting a usual so-called surface developing process.

In the above-mentioned, as methods for selectively forming fog nuclei, a method generally called "light fogging method" wherein the second exposure is given on the whole surface of the light-sensitive layers (for example, U.K. Pat. No. 1,151,363) and a method generally called "chemical fogging method" wherein nucleating agents are used have been known. The latter method is disclosed in, for example, Research Disclosure, vol. 151, No. 15,162 (published in November, 1976), pages 76 to 78.

A direct positive color image may be formed by conducting surface color developing of internal latent image type silver halide light-sensitive materials after or while they are subjected to fogging process, and thereafter subjecting then to bleaching and fixing processes or bleach-fixing process. Water washing and/or stabilizing process are generally conducted after bleaching and fixing processes.

Various methods have hitherto been developed for making development speed and color forming rate of a color developing solution faster. Especially, it is necessary that a color developing agent itself is taken into oil drops in which couplers are dispersed, when an oxidized color developing agent is finally coupled with the coupler to form a dye, and various additives as additives for hastening its permeation and promoting coloring have been known. As such as additive exhibiting especially great coloring promoting effect, benzyl alcohol has hitherto been known and used for process of various color photographic light-sensitive materials and are widely used now.

Benzyl alcohol is very low in water solubility, and thus to use diethylene glycol, triethylene glycol or alkanolamine have been widely used in order to enhance its solubility.

However, when waste water containing these compounds and benzyl alcohol itself is processed, a problem arises that load for environmental pollution countermeasure is large because of high BOD and COD values of the waste water. Therefore, in spite of above-mentioned advantages such as improvement of coloring property and solubility thereby, it has been desired to reduce or remove benzyl alcohol from the viewpoint of waste water process.

Further, solubility of benzyl alcohol is still inadequate even when the aforementioned solvent such as diethylene glycol is used, and it was a cause of bringing load in labor and time for preparing developing solution.

Further, when benzyl alcohol is brought about with the developing solution in the subsequent bleaching bath or bleach-fixing bath and accumulated, a certain kind of coupler forms a leuco dye, which is a cause of lowering color density. Further, accumulation of benzyl alcohol makes washing out the components of the developing solution, above all the color developing agents inadequate, and as a result, image preservability owing to the remaining color developing agents are sometimes deteriorated.

From the above various view, it has been desired to reduce or remove benzyl alcohol from a color developing solution.

The color laboratory industry has these problems on the one hand, and is also driven by necessity of shortening process time on the other hand because of strong request for shortening the period for finishing of a print.

However, it is apparent that color density will remarkably be lowered if development time is shortened and benzyl alcohol is removed from the color developing solution. Thus, these requests cannot simultaneously be satisfied according to the conventional art.

Further, in usual chemical fogging methods, effect of the nucleating agent is obtained only at a high pH of 12 or more. However, deterioration of the developing agent is liable to occur because of air oxidation in such a high pH condition and unstable, and as a result development activity is remarkably lowered. Furthermore, usual chemical fogging methods take a long time for processing because development speed is slow, and especially when a developing solution of a low pH is used, they take a much longer time for processing.

In case of light fogging methods, a high pH condition is not required and thus the method is relatively advantageous in practical use. However, various technical problems should be solved in order to utilize the method for various purpose in comprehensive photographic fields. That is, as light fogging method is based on formation of fog nucleus by photolysis of silver halide, appropriate exposure illuminance and exposure intensity therefor changes depending on the kind and property of silver halide to be used. Therefore, there is a problem that it is difficult to conduct a constant photofinishing and further, development apparatus is complicated and expensive.

Thus, it has been difficult in both the usual fogging methods to obtain a good direct positive image. As a means for solving the problem, compounds exhibiting a nucleating action even at pH 12 or below have been proposed in Japanese Published Unexamined Patent Application No. 69613/1977 and U.S. Pat. Nos. 3,615,615 and 3,850,638. However, these nucleating agents act on silver halide or they themselves decompose during preservation of the light-sensitive materials before process. Thus, there is a defect in the nucleating agents that they after all lower the maximum image density after processing.

U.S. Pat. No. 3,227,552 discloses to raise development speed at medium concentration using a hydroquinone derivative. However, development rate was not adequate even by use of the compound, and especially only an inadequate development rate was obtained in case of a developing solution of pH 12 or less.

Further, Japanese Published Unexamined Patent Application No. 170843/1985 discloses that maximum image density is raised by adding a mercapto compound having a carboxyl or sulfo group. However, the effect obtained by the addition of these compounds is small. Moreover, pH value of the developing solution is 12.0 and thus stability of the developing solution is inadequate.

Japanese Published Unexamined Patent Application No. 134848/1980 discloses that the formation of a rereversal nagative image is prevented by processing the materials in the presence of a nucleating agent with a processing solution (pH 12.0) containing a tetrazaindene compound to lower the minimum image density. However, this method does not increase the maximum image density and development rate.

Japanese Published Examined Patent Application No. 12709/1970 discloses that a triazoline-thion or tetrazolinethion compound is added as an antifoggant to a light-sensitive material capable of forming a direct positive image in a light fogging method. However, even these method could not attain a high maximum image density and fast development rate.

As apparent from the foregoing, there have even been no techniques that gives a direct positive color image having a high maximum color image density and low minimum color image density constantly by processing the material in a short time using a color developing solution of a low pH, i.e. pH 12 or less.

Further, there is a problem that the higher speed of a direct positive emulsion the greater the formation of rereversal negative image in exposure under a high illuminance.

SUMMARY OF THE INVENTION

The present invention has mainly two objects.

An object of this invention is to provide a method for forming a direct positive color image where the reduction of color density is low even if a color photographic material is processed in a short time using a color developing solution which does not substantially contain benzyl alcohol, and particularly to provide a color photographic light-sensitive material giving an effective coloring in such a condition and a method for forming a color image using the material.

Another object of the present invention is to provide a method for forming rapidly and constantly a direct positive color image having a high maximum color density and low minimum image density by processing an internal latent image type silver halide light-sensitive material which is not fogged in advance, that is unfogged, with a color developing solution of a low pH in the presence of a nucleating agent.

Another object of this invention is to provide a method for forming a direct positive color image having only a small possibility of the generation of a rereversal negative image upon exposure of a high illuminance.

Further object is to provide a method for forming a direct positive color image where the maximum image density and minimum image density are hard to change from respective optimum values and further the color reproduction is hard to change even when the pH and temperature of the color developing solution change.

Further object is to provide a method for forming a direct positive color image where the maximum image density and minimum image density are hard to change from respective optimum values and further the color reproduction is hard to change even when the color development time changes from its standard time.

Further object is to provide a method for forming a direct positive color image where the maximum image density is hard to be lowered and further the minimum image density is hard to be raised when the light-sensitive materials are preserved for a long period.

The other object is to provide a method for forming a direct positive color image where the developing solution is hard to be deteriorated by air oxidation, etc. and thus maintains stable performance.

These objects of the present invention can be attained by the following method for forming a direct positive color image, that is to say, in a method for forming a direct positive color image which comprises image-wise exposing a light-sensitive material comprising a support having provided thereon at least one photograhic emulsion layer containing unfogged internal latent image type silver halide grains and a color image-forming coupler; developing the light-sensitive material with a surface developing solution containing an aromatic primary amine type color developing agent in the presence of a nucleating agent and/or fogging exposure; bleaching and fixing the resulting material to form a direct positive color image, the improvement where the pH of the developing solution is 11.5 or less; the color coupler itself is a substantially non-diffusible compound which forms or releases a substantially non-diffusible dye by oxidation coupling with the aromatic primary amine type color developing agent; and the internal latent image type silver halide grain has a core/shell built-up structure wherein the core is composed of silver bromide, silver bromoiodide, silver bromochloride or silver bromochloroiodide which contains 90 mol% or more of silver bromide and 10 mol% or less of silver iodide, and the shell is composed of silver bromochloride or silver chloride which contains 20 mol% or more of silver chloride.

According to one aspect of the present invention, the developing solution does not substantially contain benzyl alcohol and the shell is composed of silver bromochloride containing 20 mol% or more of silver halide. (This is hereinafter referred to as Process I).

According to the other aspect of the present invention, the development is conducted in the presence of a nucleating agent and the nucleating agent is at least one compound selected from the group consisting of the compounds represented by the general formula (I) or (II) which are described later (This is hereinafter referred to as Process II. Further, in the following description simply stated "the present invention" comprises both Process I and Process II).

As for Process II, by using an internal latent image type silver halide grain having a particular core/shell structure and a particular nucleating agent together, a direct positive color image is formed in spite of use of a color developing solution of a low pH of 11.5 or less. Thus, in Process II, oxidation of the developing solution is restrained and therefore stability of the solution is improved. Moreover, the nucleating agent effectively works even in such a low pH condition, and as a result, the maximum density of the direct positive image is high and it takes only a short development time to obtain a constant direct positive image density. It is to be suprising that development-promoting effect in such a low pH range is equal to or more than that obtained when development is conducted in a high pH condition. Process II has a furtehr advantage in that the minimum image density is low.

Though Process I and Process II have somewhat different constructions in the point that the former excludes benzyl alcohol and the latter necessiates the presence of a particular nucleating agent, they have constructions common in many characteristic and preamble components of the invention, especially in the points that a developing solution of a particular pH range, a particular color coupler and an internal latent image type silver halide grain having a particular core/shell structure are used. Further, the object and effect of Process I and Prcoess II are somewhat different, but are common in the points that the object and effect lie in maintaining a practically effective color density in a short time of development process. That is, in Process I, lowering of color density owing to absence of benzyl alcohol is covered mainly by use of an internal latent image type silver halide grain of the particular core/shell structure, while in Process II lowering of color density or extension of development time owing to the use of a low pH developing solution is covered by use of an internal latent image type silver halide grain of the particular core/shell structure and by use of a particular nucleating agent.

DETAILED DESCRIPTION OF THE INVENTION

The unfogged internal latent image type silver halide grain used in the present invention means a silver halide grain whose surface is not fogged in advance and which forms a latent image mainly inside the grain. Preferred one as such grains is such a silver halide grain that a maximum density measured according to an ordinary method for measuring a photographic density after an emulsion containing the particles (that is, an internal latent image type silver halide emulsion) is applied in a predetermined amount on a transparent support, exposed to light for a fixed time in the range of 0.1 to 10 seconds and then developed in the following developing solution B (an internal type developing solution) at 18° C. for 5 minutes, is at least 5 times, preferably at least 10 times the maximum density obtained when the silver halide emulsion which had been applied in the same amount as above and exposed to light in the same manner as above, was developed in the following developing solution A (a surface type developing solution) at 20° C. for 6 minutes.

| | |
|---|---|
| Surface developing solution A | |
| Metal | 2.5 g |
| l-Ascorbic acid | 10 g |
| $NaBO_2.H_2O$ | 35 g |
| KBr | 1 g |
| Water to | 1 l |
| Internal developing solution B | |
| Metal | 2 g |
| Sodium hydrosulfite (anhydrous) | 90 g |
| Hydroquinone | 8 g |
| Sodium carbonate (monohydrate) | 52.5 g |
| KBr | 5 g |
| KI | 0.5 g |
| Water to | 1 l |

In the present invention, especially in Process I, the core grain may be formed in the conversion method. Further, the core grain may be chemically sensitized according to one or more of ordinary methods such as gold sensitization, sulfur sensitization, reduction sensitization and the like, or it is also possible to conduct no chemical sensitization. Further, it is possible to dope a metal such as iridium, palladium and rhodium.

Although it is not necessary to chemically sensitize the shell, but it is better to do so.

Specific examples of the internal latent image type silver halide emulsion usable in the present invention, especially in Process I, include a conversion type silver halide emulsion and core/shell type silver halide emulsion. Examples of the core/shell type silver halide emulsions include those disclosed in Japanese Published Unexamined Patent Application Nos. 32813/1972, 32814/1972, 134721/1977, 156614/1977, 60222/1978, 66218/1978, 66727/1978, 127549/1980, 136641/1982, 70221/1983, 208540/1984, 216136/1984, 107641/1985, 247237/1985, 2148/1986 and 3137/1986; Japanese Published Examined Patent Application Nos. 18939/1981, 1412/1983, 1415/1983, 6935/1983 and 105528/1983; Japanese Patent Application No. 36424/1986; U.S. Pat. Nos. 3,206,313, 3,317,322, 3,761,266, 3,761,276, 3,850,637, 3,923,513, 4,035,185, 4,395,478 and 4,504,570; EP No. 0017148; Research Disclosure RD 16345 (published in November, 1977) and the like.

The internal latent image-type silver halide grain used in the present invention, especially in Process II has a core/shell built-up structure. The core is composed of silver bromide, silver iodide, silver bromochloride or silver bromochloroiodide which contains 90 mol% or more of silver bromide and 10 mol% or less, preferably 3 mol% or less, particularly 1 mol% or less of silver iodide, and the core may be a so-called conversion type grain or ordinal grain. The shell is composed of silver chloride or silver bromochloride containing 20 mol% or more, preferably 40 mol% or more of silver chloride, and usually formed by precipitating the silver chloride or silver bromochloride on the surface of the core grain. As the silver halide emulsion having the core/shell type structure, there may be appropriately used an emulsion disclosed in Japanese Published Unexamined Patent Application No. 127549/1980, U.S. Pat. No. 4,395,478, West German Pat. No. 2,332,802 C2 and the like.

Preferred average grain size of silver halide grains used in the present invention, is 1.5μ or less and 0.2μ or more, especially 1.2μ or less and 0.4μ or more.

In this connection, the grain size means grain diameter in case of a spherical or sphere-like grain and edge length in case of a cubic grain, respectively, and is represented as average length based on projective area.

Grain size distribution may be narrow or wide. However, from the viewpoint of improvement of graininess, sharpness and the like, it is preferable to use a so-called "monodispersed" silver halide emulsion having a narrow grain size distribution in which 90% or more, especially 95% or more by grain number or by weight of total grains are fallen within ±40%, preferably within ±30%, particularly within ±20% of the average grain size. Further, in order to obtain a light-sensitive material which gives desired gradation, it is possible to form an emulsion layer having substantially the same color sensitivity, by incorporating two or more monodispersed silver halide emulsions containing different-sized grains, or plural kinds of grains having the same sizes but different speed as a mixture in the same layer or in different layers. Further, it is also possible to use combination of two or more multi-dispersed silver halide emulsions or combination of a monodispersed emulsion with a multi-dispersed emulsion in a mixture in a layer or in multiple layers.

Silver halide grains used in the present invention may have regular crystal shapes such as cubes, octahedrons, dodecahedrons and tetradecahedrdons, irregular crystal shapes such as spheres, or their combinated shapes. Further, it is possible to use an emulsion containing tabular grains, especially an emulsion wherein tabular grains having the length/thickness ratio of 5 or more, especially 8 or more are contained in a ratio of 50% or more of the total projected areas of the grains. Further it is possible to use an emulsion containing a mixture of these various crystals.

Silver halide emulsions as used in the present invention, especially Process II may be chemically sensitized inside or on the surface of the grains according to a method of sulfur or selenium sensitization, reduction sensitization, noble metal sensitization and the like alone or in combination.

Photographic emulsions used in the present invention may be spectrally sensitized by photographic sensitizing dyes in a conventional manner. Especially useful dyes are cyanine dyes, merocyanine dyes and composite merocyanine dyes, which may be used alone or in combination. Further, it is possible to use the above dyes and supersensitizing agents together. Specific examples thereof and methods for using them and disclosed, for example in Research Disclosure No. 17,643 (December, 1978) IV, etc.

A benzenethiosulfonic acid, a benzenesulfinic acid, a thiocarbonyl compound or the like may be contained in the photographic emulsion used in the present invention for the purpose of preventing fog of the light-sensitive material during preparation, preservation or photographic process, or stabilizing photographic performance.

Specific examples of antifoggants or stabilizers and detailed methods of using them are disclosed, for example, in U.S. Pat. Nos. 3,954,474 and 3,892,947, Japanese Published Exampled Patent Application No. 28660/1977, Research Disclosure No. 17,643 (published in December, 1978), VI A–VI M, B. J. Biar, "Stabilization of Photographic Silver Halide Emulsions" (Focal Press, published in 1974) and the like.

Preferably, nucleating agents useful for the present invention are compounds represented by the following general formula (I) or (II).

The general formula (I)

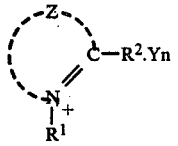

(wherein, Z represents nonmetal atoms necessary for forming a 5- or 6-membered heterocyclic ring and may be substituted; $R^1$ is an aliphatic group; $R^2$ is a hydrogen atom, an aliphatic group or an aryl group; $R^1$ and $R^2$ may be substituted, provided that at least one of $R^1$, $R^2$ and Z groups contain an alkynyl group, an acyl group, a hydrazine group or a hydrazone group, or $R^1$ and $R^2$ are combined to form dihydropyridinium skeleton as a 6-membered ring, further, at least one of $R^1$, $R^2$ and Z may contain $X^1(L^1)_{m-1}$ wherein $X^1$ is a group for promoting adsorption on silver halide and $L^1$ is a bivalent linking group; Y is a counter ion for electrical charge balance; n is 0 or 1; and $m^1$ is 0 or 1).

In more detailed explanation, the heterocyclic ring as completed by Z includes quinolinium, benzothiazolium, benzimidazolium, pyridinium, thiazolinium, thiazolium, naphthothiazolium, selenazolium, benzoselenazolium, imidazolium, tetrazolium, indolenium, pyraolinium, acridinium, phenanthridinium, isoquinolinium, oxazolium, naphthoxazolium and benzoxazolium rings.

The substituents of Z include alkyl groups, alkenyl groups, aralkyl groups, aryl groups, alkynyl groups, hydroxy group, alkoxy groups, aryloxy groups, halogen atoms, amino groups, alkylthio groups, arylthio groups, acyloxy groups, acylamino groups, sulfonyl groups, sulfonyloxy groups, sulfonylamino groups, carboxyl groups, acyl groups, carbamoyl groups, sulfamoyl groups, sulfo groups, cyano group, ureido groups, urethane groups, carbonic acid ester groups, hydrazine groups, hydrazone groups or imino groups. As substituent on Z, at least one group is selected, for example from the above-mentioned substituents, and when two or more groups are selected, they may be the same or different. The above-mentioned substituents may further be substituted with these substituents.

Further, the substituent may have heterocyclic quaternary ammonium group as completed through an appropriate linking group L. In this occasion, so-called dimer structure is formed.

Preferred heterocyclic rings as completed by Z contains quinolinium, benzothiazolium, benzimidazolium, pyridinium, acridinium, phenanthaidinium and isoquinolinium nuclei; preferred ones are quinolinium, benzothiazolium and benzimidazolium, especially quinolinium and benzothiazolium. Most preferred one is quinolinium.

Aliphatic group of $R^1$ and $R^2$ is a nonsubstituted alkyl group having 1–18 carbon atoms and a substituted alkyl group, the alkyl part of which has 1–18 carbon atoms. The substituents on $R^1$ or $R^2$ include those mentioned as the substituents on Z.

The aryl group as represented by $R^2$ is those having 6–20 carbon atoms, for example a phenyl group, a naphthyl group, etc. The substituents on $R^2$ include those mentioned as the substituents on Z.

At least one of the groups represented by $R^1$, $R^2$ and Z has an alkynyl group, an acyl group, a hydrazino group or a hydrazono group, or $R^1$ and $R^2$ are combined to form a dihydropyridinium skeleton as a 6-membered ring. These groups may be substituted with the substituents on Z.

The hydrazine groups having an acyl group or a sulfonyl group are preferable.

As the hydrazone group, those having an aliphatic group or an aryl group as the substituent are preferable.

As the acyl group, a formyl group, and an aliphatic or aromatic ketone are, for example, preferred.

The alkynyl substituent which is placed on anyone of $R^1$, $R^2$ and Z, is now described more in detail. Preferably they include those having 2–18 carbon atoms, for example ethynyl group, propargyl group, 2-butynyl group, 1-methylpropargyl group, 1,1-dimethylpropargyl group, 3-butynyl group, 4-pentynyl group, etc.

Further, these groups may be substituted with the group mentioned as substituents of Z. Examples include 3-phenylpropargyl group, 3-methoxycarbonylpropargyl group and 4-methoxy-2-butynyl group.

Preferred are the compounds where at least one of the groups represented by $R^1$, $R^2$ and Z or the substituents on the ring is an alkynyl group or an acyl group, or the compounds where $R^1$ and $R^2$ are combined to form a dihydropyridinium skeleton, and particularly preferred are the compounds where at least one alkynyl gorup is contained as the substituents of the groups or ring represented by $R^1$, $R^2$ and Z.

Preferred examples of the group promoting the adsorbance of the compounds onto silver halide grains as represented by $X^1$ include a thioamido group, a mercapto group, and a nitrogen-containing 5- or 6-membered heterocyclic group.

The thioamido adsorbance-promoting group as represented by $X^1$ is a bivalent group represented by $$-\overset{\overset{\displaystyle S}{\|}}{C}-\text{amino},$$

and may be a part of the ring structure or non-cyclic thioamido group. Useful thioamido adsorbance-promoting group can be selected from those disclosed, for example, in U.S. Pat. Nos. 4,030,925, 4,031,127, 4,080,207, 4,245,037, 4,255,511, 4,266,013 and 4,276,364, and Research Disclosure 151, No. 15162 (November, 1976) and ibid. 176, No. 17626 (December, 1978).

Specific examples of the non-cyclic thioamido groups include a thioureide group, a thiourethane group, dithiocarbamic acid ester group, etc., and specific examples of the cyclic thioamido groups include 4-thiazoline-2-thione, 4-imidazoline-2-thion, 2-thiohydanthoin, rhodanine, thiobarbituric acid, tetrazoline-5-thion, 1,2,4-triazoline-3-thion, 1,3,4-thiadiazoline-2-thion, 1,3,4-oxadiazoline-2-thion, benzimidazoline-2-thion, benzoxazoline-2-thion, benzothiazoline-2-thion, etc. These groups may further be substituted.

The mercapto group of $X^1$ may be directly bonded to the group represented by $R^1$, $R^2$ or Z or to a substituent on the group represented by $R^1$, $R^2$ or Z. After all, the mercapto group includes an aliphatic mercapto group, an aromatic mercapto group and a heterocyclic mercapto group (When the group adjacent to the carbon atom to which a —SH group is bonded is a nitrogen atom, the mercapto group is the same as the cyclic thioamido group which is a tautomer thereof, and examples of these groups are the same as those enumerated above).

The nitrogen-containing 5- or 6-membered heterocyclic group represented by $X^1$ includes nitrogen-containing 5- or 6-membered heterocyclic ring consisting of combination of nitrogen, oxygen, sulfur and carbon, preferably benzotriazole, triazole, tetrazole, indazole, benzimidazole, imidazole, benzothiazole, thiazole, benzoxazole, oxazole, thiadiazole, oxadiazole, triazine, etc. These groups may further be substituted with an appropriate substituent. Such substituent includes those enumerated as the substituents of Z. Preferred nitrogen-containing heterocyclic rings are benzotriazole, triazole, tetrazole and indazole, and particularly preferred one is benzotriazole.

The bivalent linking group represented by $L^1$ includes atoms or atomic groups containing at least one of C, N, S and O, specifically, for example, an alkylene group, an alkenylene group, an alkynylene group, an arylene group, —O—, —S—, —NH—, —N=, —CO—, —$SO_2$— (these groups may have a substituent), etc. alone or in combination thereof.

The counter ion Y for electrical charge balance is any negative ion which can countervail positive electrical charge owing to quaternary ammonium salt in the heterocyclic ring, and includes, for example, bromide ion, chloride ion, iodide ion, p-toluenesulfonate ion, ethylsulfonate ion, perchlorate ion, trifluoromethanesulfonate ion, thiocyanate ion, etc. In this case n is 1. When the heterocyclic quaternary ammonium salt contains a negative ion substituent such as a sulfoalkyl substituent, the salt can take a form of a betaine, and in the occasion the counter ion is not necessary and n is 0. When the heterocyclic quaternary ammonium salt has two negative ion substituents, for example, two sulfoalkyl groups, Y is positive ionic counter ion and includes, for example, alkali metal ion (sodium ion, potassium ion, etc.), ammonium salts (triethylammonium, etc.) etc.

The following are specific examples of the compounds represented by the general formula (I), but the compounds are not limited thereto.

(1)
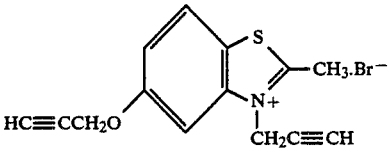
(2)
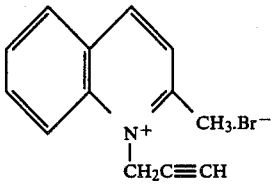
(3)
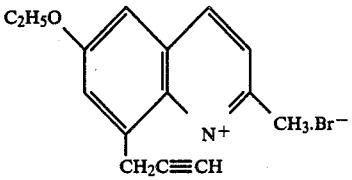
(4)
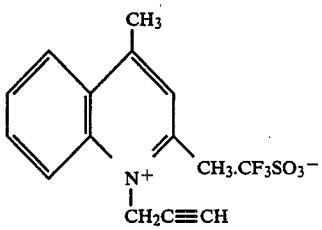
(5)
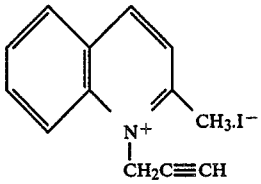
(6)
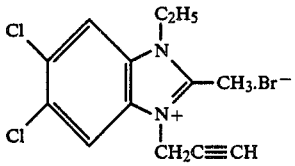
(7)
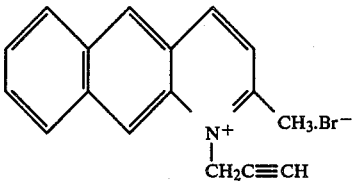
(8)
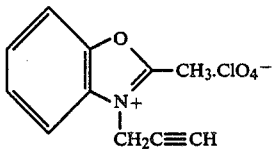
(9)
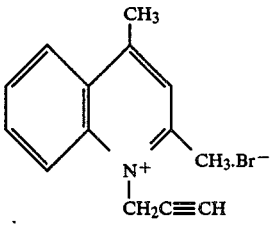
(10)
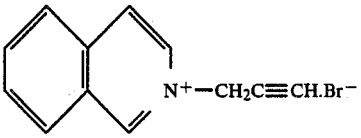
(11)
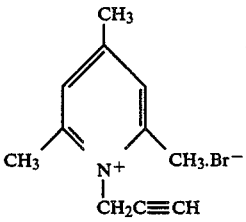
(12)
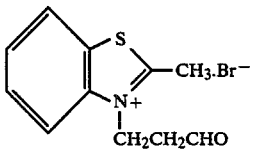
(13)
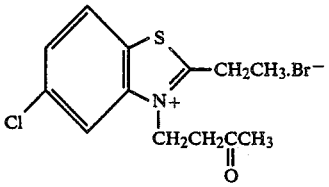
(14)
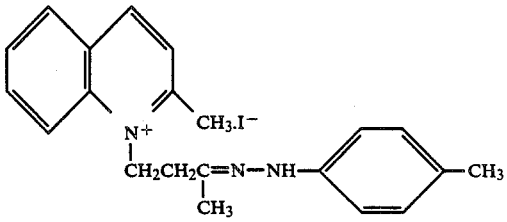

-continued
(15)
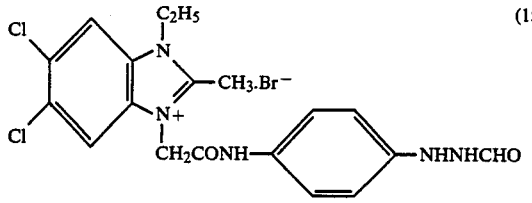
(16)
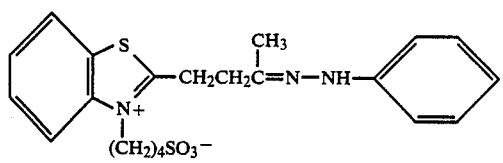
(17)
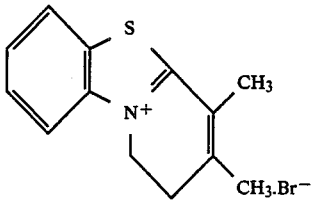
(18)
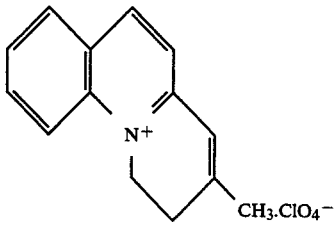
(19)
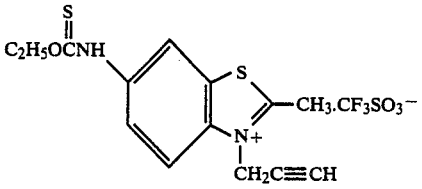
(20)
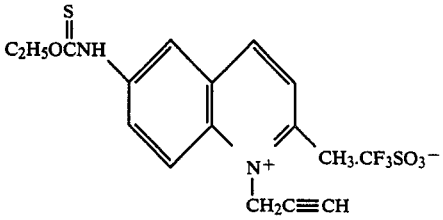
(21)
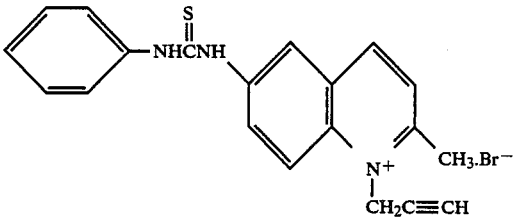
(22)
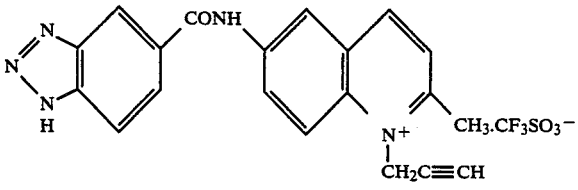
(23)
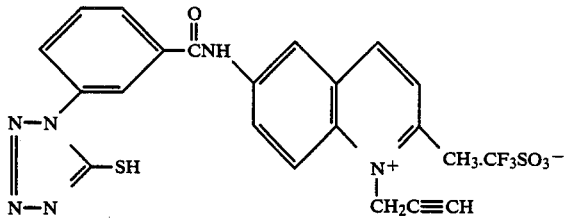
(24)
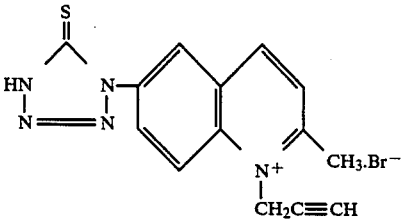
(25)
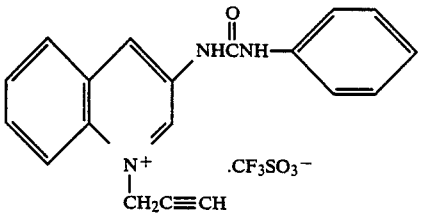

-continued
(26)
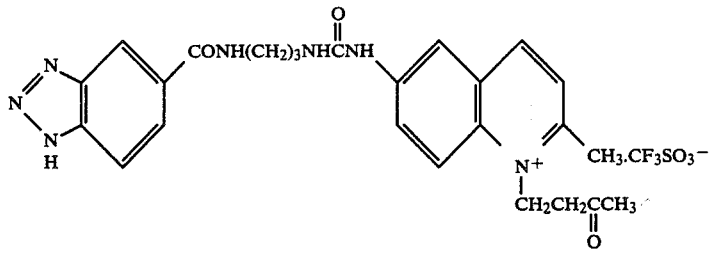
(27)
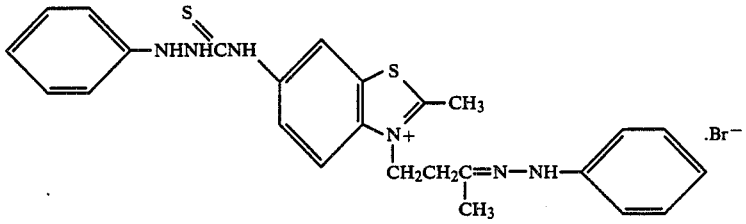
(28)
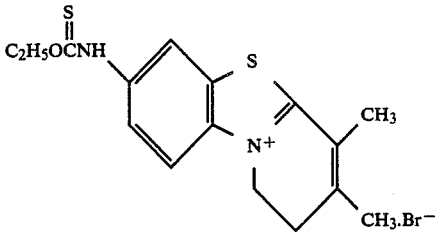
(29)
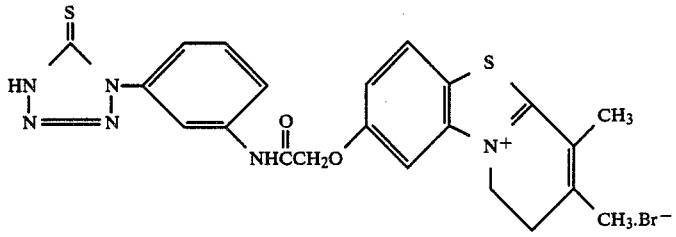
(30)
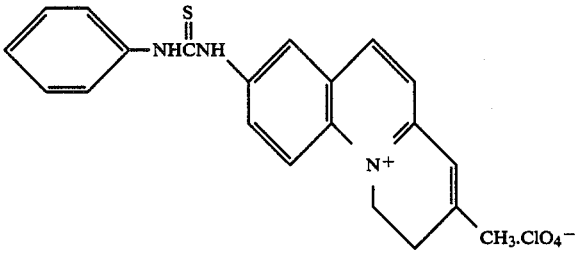
(31)
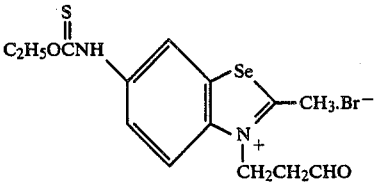

-continued (32)

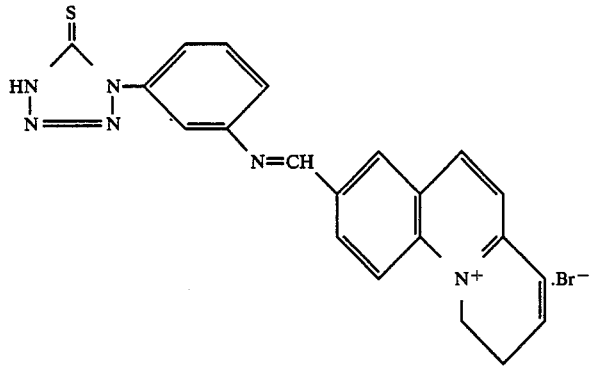

(33)

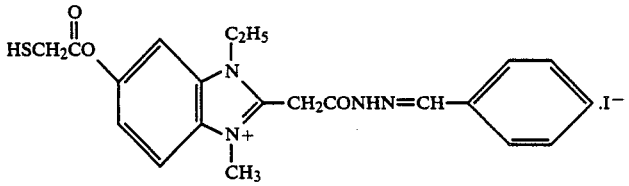

(34)

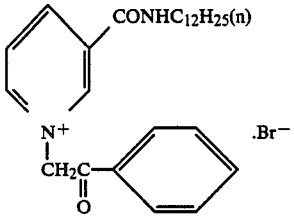

(35)

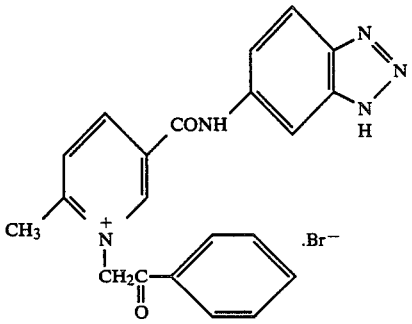

The above-mentioned compounds can be synthesized according to the processes disclosed, for example in the patents cited in Research Disclosure No. 22,534 published in January, 1983, pages 50 to 54, U.S. Pat. No. 4,471,044, etc. or according to the analogous process thereof.

The general formula (II)

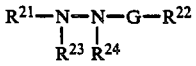

wherein, $R^{21}$ represents an aliphatic group, an aromatic group or a heterocyclic group; $R^{22}$ represents a hydrogen atom, an alkyl group, an aralkyl group, an aryl group, an alkoxy group, an aryloxy group or an amino group; G represents a carbonyl group, a suflonyl group, a sulfoxy group, a phosphoryl group or an iminomethylene group (HN=C<); $R^{23}$ and $R^{24}$ are both hydrogen atoms, or one of them represents hydrogen atom and the other represents any one of an alkylsulfonyl group, an arylsulfonyl group or an acyl group. In this connection, the part consisting of G, $R^{23}$, $R^{24}$ and hydrazine nitrogens may also form a hydrazone structure (>N—N=C<). Further, the above-mentioned groups may have a substituent, if possible.

The aliphataic group represented by $R^{21}$ in the general formula (II) is a straight-chain, branched or cyclic alkyl group, alkenyl group or alkynyl group.

The aromatic group represented by $R^{21}$ includes monocyclic or bicyclic aryl groups, for example, a phenyl group, a naphthyl group, etc.

The heterocyclic rings represented by $R^{21}$ are 3- to 10-membered saturated or unsaturated heterocyclic rings containing at least one of N, O and S atoms, and may be monocycles or form condensed ring together with other aromatic rings or heterocyclic rings. Preferred heterocyclic rings include 5- or 6-membered aromatic heterocyclic groups, for example, a pyridyl group, a quinolinyl group, an imidazolyl group, a benzimidazolyl group, etc.

$R^{21}$ may have a substituent which may further be substituted. Examples of such substituents include an alkyl group, an aralkyl group, an alkoxy group, an aryl group, a substituted amino group, an acrylamino group, a sulfonylamino group, an ureido group, an urethane group, an aryloxy group, a sulfamoyl group, a carbamoyl group, an aryl group, an alkylthio group, an arylthio group, a sulfonyl group, a sulfinyl group, a hydroxy group, a halogen atom, a cyano group, a sulfo group, carboxyl group, etc.

These groups may be combined together to form a ring, if possible.

Preferred $R^{21}$ groups are aromatic groups, aromatic heterocyclic rings or aryl-substituted methyl groups, and particularly preferred one is aryl groups.

Preferred groups of those represented $R^{22}$ are, in case of G being a carbonyl group, a hydrogen atom, an alkyl group (for example, a methyl group, a trifluoromethyl group, a 3-hydroxypropyl group, a 3-methanesulfonamidopropyl group, etc.), an aralkyl group (for example, o-hydroxybenzyl group, etc.), an aryl group (for example, a phenyl group, a 3,5-dichlorophenyl group, an o-methanesulfonamidophenyl group, a 4-methanesulfonylphenyl group, etc.), etc., and a hydrogen atom is especially preferable.

When G is a sulfonyl group, preferred $R^{22}$ groups are an alkyl group (for example, a methyl group, etc.), an aralkyl group (for example, an o-hydroxyphenylmethyl group, etc.), an aryl group (for example, a phenyl group, etc.), a substituted amino group (for example, a dimethylamino group, etc.), etc.

As the substituent on $R^{22}$, the substituents enumerated in respect of $R^{21}$ can be used, and further, an acyl group, an acyloxy group, an alkyl or aryloxycarbonyl group, an alkenyl group, an alkynyl group, a nitro group, etc. can also be used.

These substituents may further be substituted with these substituents. Further, these groups may be combined together to form a ring, if possible.

It is preferable that $R^{21}$ or $R^{22}$, especially $R^{21}$ contains a diffusion-resistant group in couplers, that is so-called ballast group. The ballast group has 8 or more of carbon atoms and consists of an alkyl group, a phenyl group, an ether group, an amido group, an ureido group, an urethane group, a sulfonamido group, a thioether group, etc. or combinations thereof.

$R^{21}$ or $R^{22}$ may have a group $X^2$—$(L^2)_{m-2}$ for promoting adsorption of compounds represented by the general formula (II) onto the surface of silver chloride grains. In this connection, $X^2$ has the same meaning as that of $X^1$ in the general formula (I), and preferably, is a thioamido group (excluding unsubstituted and substituted thiosemicarbazido), a mercapto group, an ureido group, or a 5- or 6-membered nitrogen-containing heterocyclic group. $L^2$ represents a bivalent linking group and has the same meaning as that of with $L^1$ in the formula (I). $m^2$ is 0 or 1.

Particularly preferred $X^2$ groups are cyclic thioamido groups (that is, a mercapto-substituted nitrogen-containing heterocyclic ring, for example, a 2-mercaptothiadiazolyl group, a 3-mercapto-1,2,4-triazolyl group, a 5-mercaptotetrazolyl group, a 2-mercapto-1,3,4-oxadiazolyl group, a 2-mercaptobenzoxazolyl group, etc.), or nitrogen-containing heterocyclic groups (for example, a benzotriazole group, a benzimidazolo group, a indazole group, etc.).

$R^{23}$ and $R^{24}$ are the same or different groups and may be a hydrogen atom, an alkylsulfonyl group having 20 or less of carbon atoms, an arylsulfonyl group, preferably a phenylsulfonyl group or a phenylsulfonyl group substituted so that the sum of Hammett's substituent constant is −0.5 or more, an acyl group having 20 or less of carbon atoms, preferably a benzoyl group or a benzoyl group substituted so that the sum of Hammett's substituent constant is −0.5 or more, or a straight-chained, branched or cyclic unsubstituted or substituted aliphatic acyl group (the substituent includes for example a halogen atom, an ether group, a sulfonamido group, a carbonamido group, a hydroxyl group, a carboxyl group and a sulfo group).

The most desired $R^{23}$ and $R^{24}$ are a hydrogen atom, respectively.

The most desired G in the general formula (II) is a carbonyl grup.

Particularly preferred general formula (II) is those having an adsorption group onto silver halide. Especially preferred adsorption groups onto silver halide are a mercapto group, a cyclic thioamido group, an ureido group and a nitrogen-containing heterocyclic group, as hereinabove described in respect to the general formula (I).

Specific examples of the compounds represented by the general formula (II) are shown below. However, the present invention should not be limited to the following compounds.

(36)

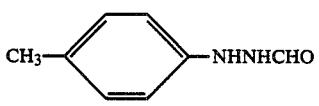

(37)

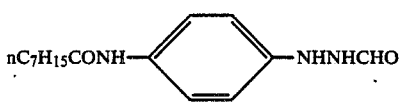

(38)

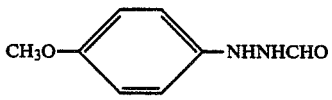

(39)

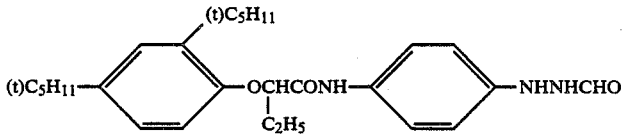

(40)

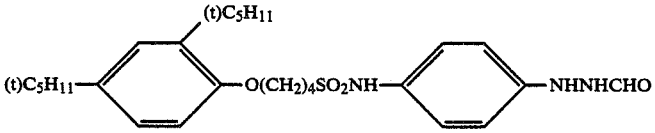

(41)

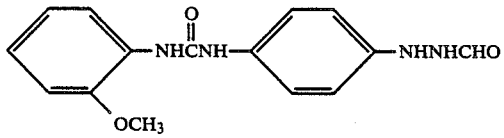

(42)

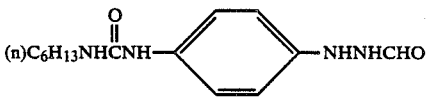

-continued
(43)
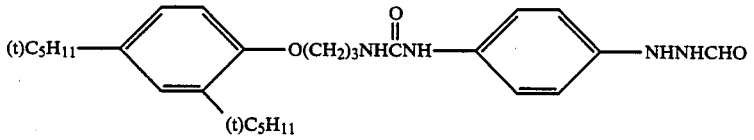
(44)
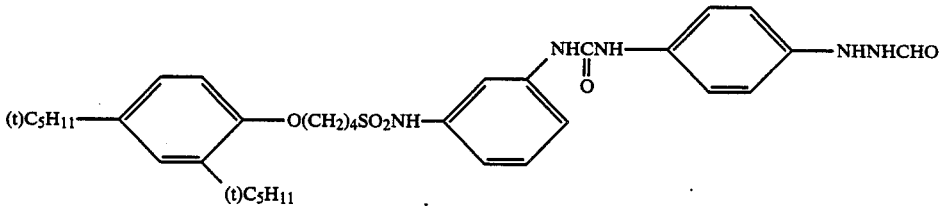
(45)
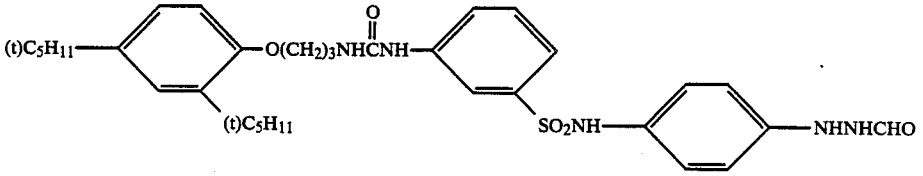
(46)
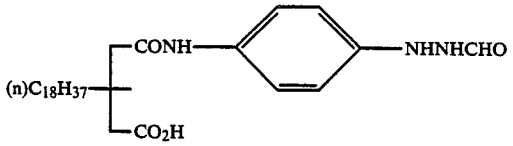
(47)
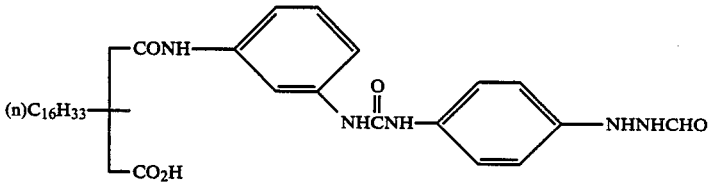
(48)
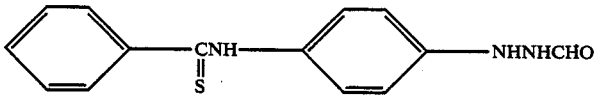
(49)
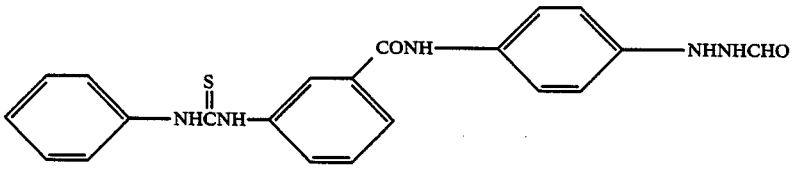
(50)
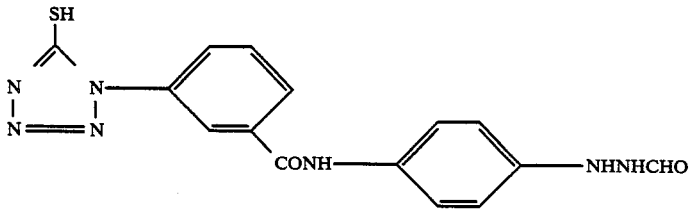

-continued
(51)
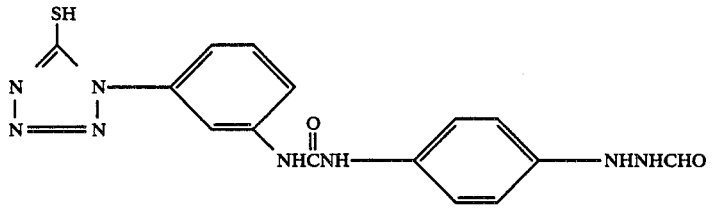
(52)
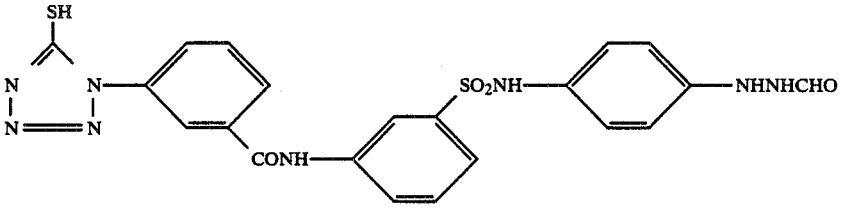
(53)
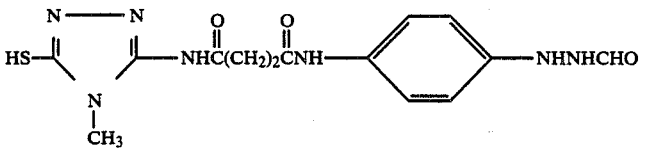
(54)
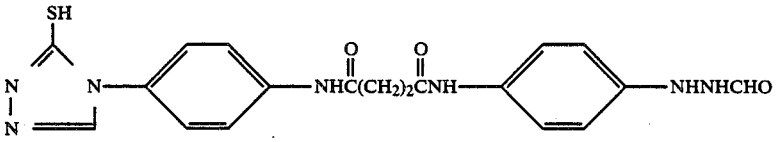
(55)
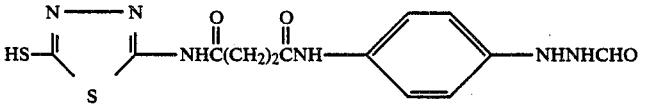
(56)
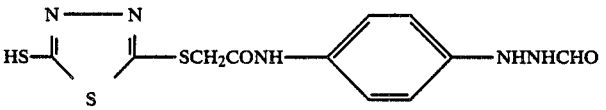
(57)
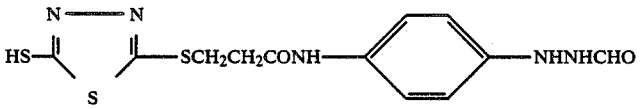
(58)
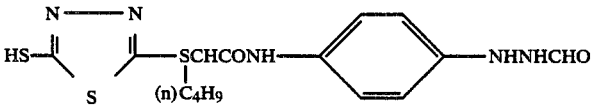
(59)
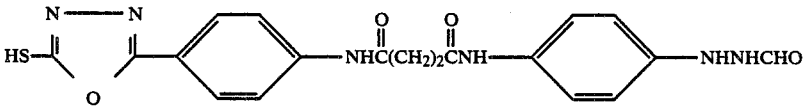
(60)
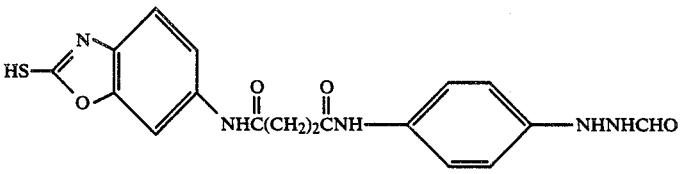

-continued
(61)
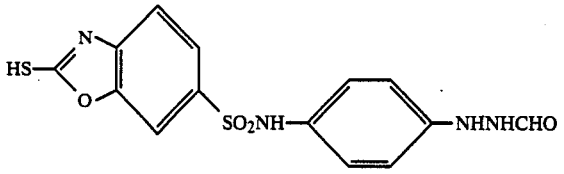
(62)
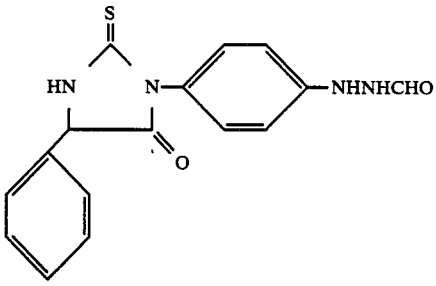
(63)
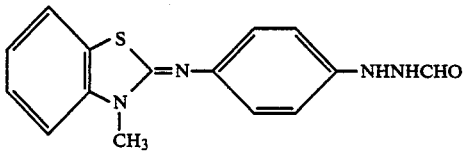
(64)
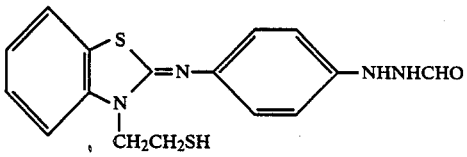
(65)
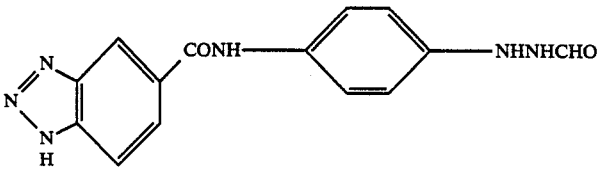
(66)
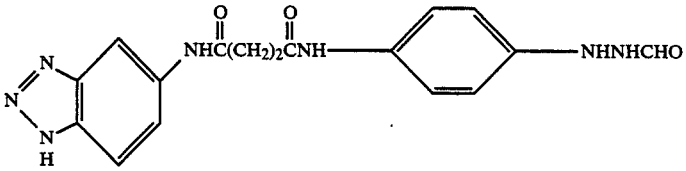
(67)
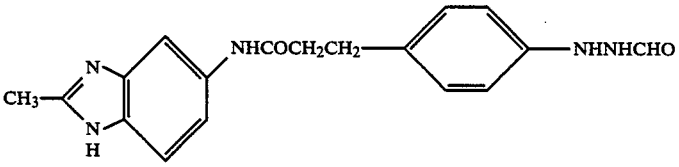
(68)
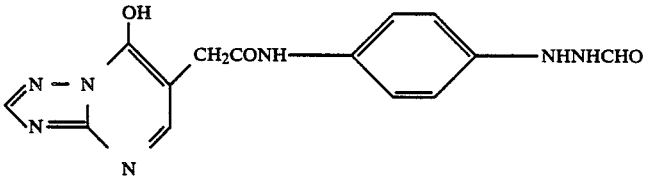
(69)
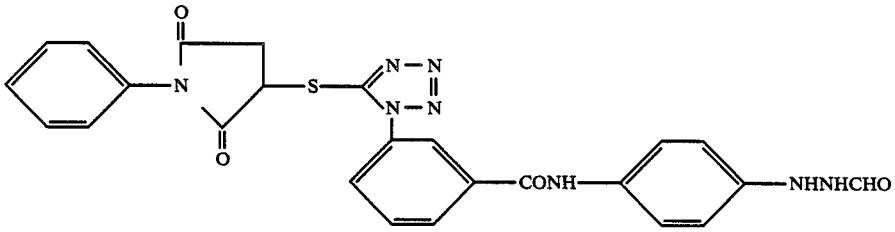
(70)
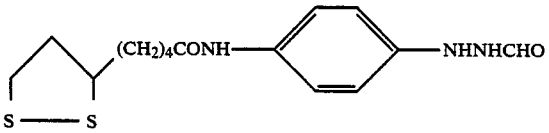

-continued (71)

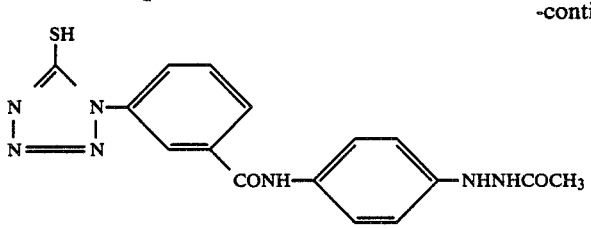

(72)

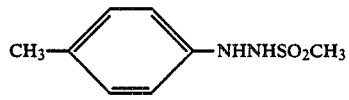

(73)

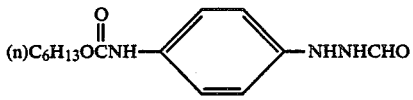

(74)

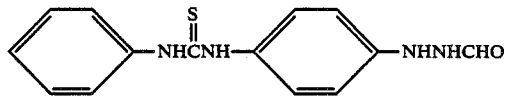

(75)

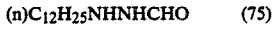

(76)

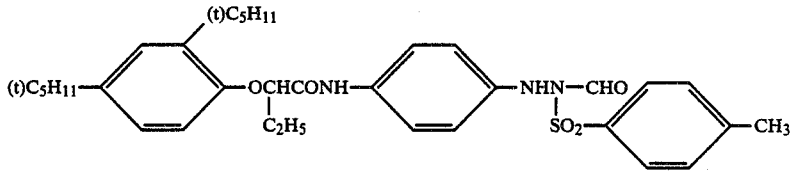

(77)

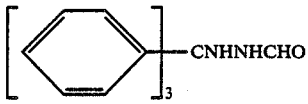

(78)

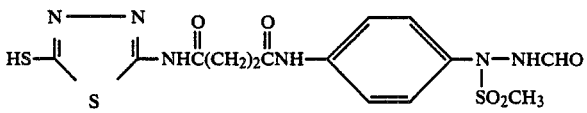

(79)

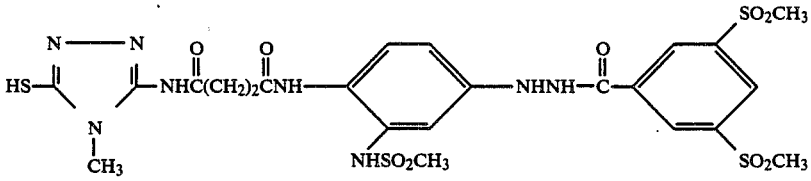

Synthesis of the compounds represented by the general formula (II) used in the present invention can be conducted according to processes described, for example, in the patents cited in Research Disclosure No. 15,162 (November, 1976, pages 76–77), ibid. No. 22,534 (January, 1983, pages 50–54) and ibid. No. 23,510 (November, 1983, pages 346–352); U.S. Pat. Nos. 4,080,207, 4,269,924, 4,276,364, 4,278,748, 4,385,108, 4,459,347, 4,478,928 and 4,560,638, U.K. Pat. No. 2,011,391B, Japanese Published Unexamined Patent Application No. 179,734/1985, etc.

Nucleating agents having an adsorption group onto silver halide are preferable sicne they are effective even when used in a small amount.

"Nucleating agent" referred to in the present specification is a substance which act, when the unfogged internal latent image-type silver halide emulsion is subjected to surface development process, to form a direct positive image.

Nucleating agents used in the present invention may be contained in the light-sensitive materials or processing solutions thereof, preferably in the light-sensitive materials.

In case of addition to light-sensitive materials, nucleating agents are, preferably added to an internal latent image type silver halide emulsion layer. However, they may also be added to other layers such as an intermediate layer, a substratum layer and back layer, so long as they diffuse to adsorb on silver halide during coating or processing. In case of addition to a process solution, nucleating agents are added to a developing solution, a low pH pre-bath as disclosed in Japanese published Unexamined Patent Application No. 178350/1983 and the like.

When the nucleating agent is contained in the light-sensitive material, the preferred amount to be used is $10^{-8}$ to $10^{-2}$ moles, especially $10^{-7}$ to $10^{-3}$ moles per 1 mole of silver halide.

Further, when the nucleating agent is added to the processing solution, its preferred amount to be used is $10^{-5}$ to $10^{-1}$ moles, especially $10^{-4}$ to $10^{-2}$ moles per 1 l of the processing solution.

Further, two or more kinds of the nucleating agents may be used together.

The whole surface exposure, namely fogging exposure in the present invention, especially in Process I is conducted after image-wise exposure, before development process and/or during development process. That is, the light-sensitive material image-wise exposed is soaked in a developing solution or a per-bath thereof, and exposed in a soaked state or in a wet state after it is taken out from these solution, and it is best to expose it in a developing solution.

As the light source of the fogging exposure, a light source within the light-sensitive wave length of the light-sensitive material may be used, and any of a fluorescent lamp, tungsten lamp, xenon lamp, sun light and the like may generally be used. When a light-sensitive material having light-sensitivity over the whole wave length range such as a color light-sensitive material is used, such a light source having a high color rendition (as resembling to white as possible) as disclosed in Japanese Published Unexamined Patent Application Nos. 137350/1981 and 70223/1983. The proper intensity of light is 0.01 to 2000 lux, preferably 0.05 to 30 lux and particularly 0.05 to 5 lux. Low intensity exposure is better for a light-sensitive material wherein a high-speed emulsion is used. Control of intensity may be conducted by changing the luminous intensity of the light source, reducing light with various filters, or changing the distance between the light-sensitive material and the light source or the angle between the light-sensitive material and the light source. It is also possible to shorten exposure time by using weaker light at the beginning and then using stronger light.

It is preferable to irradiate light after the light-sensitive material is soaked in a developing solution or a per-bath thereof and the solution adequately permeates the emulsion layer of the light-sensitive material. Time taken from soak in the solution to light fogging exposure is generally 2 seconds to 2 minutes, preferably 5 seconds to 1 minute and particularly 10 seconds to 30 seconds.

Exposure time for fog is generally 0.01 seconds to 2 minutes, preferably 0.1 seconds to 1 minute and particularly 1 second to 40 seconds.

In the present invention, the following compounds may be added for the purpose of lowering the minimum image density, enhancing preservability of the light-sensitive material, hastening development and the like. Namely, there may be mentioned hydroquinones such as compounds disclosed in U.S. Pat. Nos. 3,227,552 and 4,279,987; chromans such as those disclosed in U.S. Pat. No. 4,268,261, Japanese Published Unexamined Patent Application No. 103031/1979 and Research Disclosure No. 18264 (1979); quinones such as those disclosed in Research Disclosure No. 21206 (1981); amines such as those disclosed in U.S. Pat. No. 4,150,993 and Japanese Published Unexamined Patent Application No. 174757/1983; oxidizing agents such as those disclosed in Japanese Published Unexamined Patent Application No. 260039/1985 and Research Disclosure No. 16936 (1978); catechols such as those disclosed in Japanese Published Unexamined Patent Application Nos. 21013/1980 and 65944/1980; compounds releasing a nucleating agent during development such as those disclosed in Japanese Published Unexamined Patent Application No. 107029/1985; thioureas such as those disclosed in Japanese Published Unexamined Patent Application No. 95533/1985; and spirobisindanes such as those disclosed in Japanese Published Unexamined Patent Application No. 65944/1980.

In the present invention, a compound represented by the following general formula (III) or (IV) may be added as a nucleation-promoting agent.

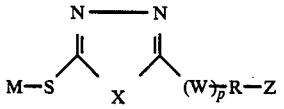

General formula (III)

wherein M represents a hydrogen atom, an alkali metal atom, an ammonium group or a group cleaning in an alkaline condition; X represents an oxygen atom, a sulfur atom or a selenium atom; W represents —S—,

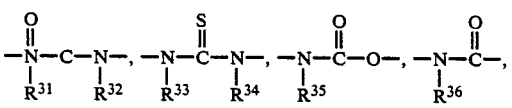

-continued

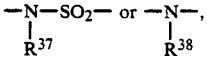

$R^{31}$, $R^{32}$, $R^{33}$, $R^{34}$, $R^{35}$, $R^{36}$, $R^{37}$ and $R^{38}$ are the same or different and independently represent a hydrogen atom, substituted or unsubstituted alkyl group, an aryl group, an alkenyl group or an aralkyl group; R represents a straight-chain or branched alkylene group, or an arylene group; Z represents a hydrogen atom, a halogen atom, a nitro group, a cyano group, a substituted or unsubstituted amino group, a quaternary ammonium group, an alkoxy group, an aryloxy group, an alkylthio group, an arylthio group, a heterocyclic oxy group, a heterocyclic thio group, a sulfonyl group, a carbamoyl group, a sulfamoyl group, a carbonamido group, a sulfonamido group, an acyloxy group, a sulfonyloxy group, an ureido group, a thioureido group, an acyl group, a heterocyclic group, an oxycarbonyl group, an oxysulfonyl group, an oxycarbonylamino group or a mercapto group; and p represents 0 or 1.

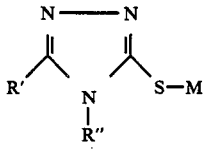

General formula (IV)

wherein R′ is a hydrogen atom, a halogen atom, a nitro group, a mercapto group, an amino group, or a group $(w)_p$ R—Z; R″ represents a hydrogen atom, an amino group or a group $(w')_q$ R—Z; W′ represents

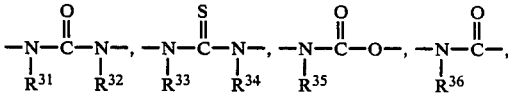

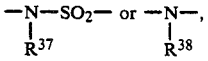

and q represents 0 or 1; and M, R, Z, W, p, $R^{31}$, $R^{32}$, $R^{33}$, $R^{34}$, $R^{35}$, $R^{36}$, $R^{37}$ and $R^{38}$ have the same meaning as individuals described in the above general formula (III), respectively.

Z in the general formulae (III) and (IV) is preferably a substituted a unsubstituted amino group, a quaternary ammonium group, an alkoxy group, an arylthio group or a heterocyclic group.

Preferred nucleation-promoting agents are specifically the following compounds, but not limited thereto.

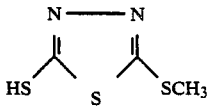

A-1

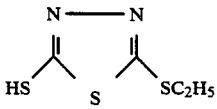

A-2

-continued
A-3
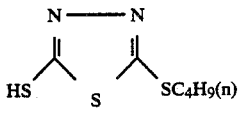
A-4
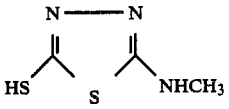
A-5
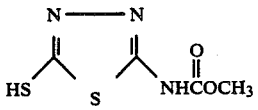
A-6
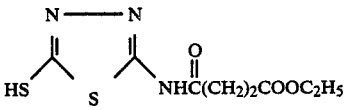
A-7
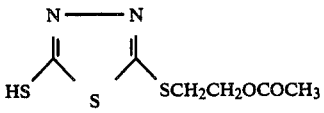
A-8
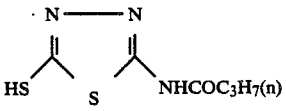
A-9
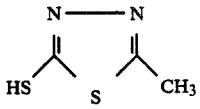
A-10
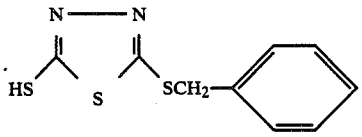
A-11
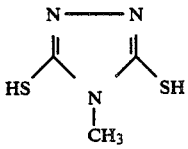
A-12
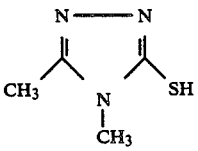
A-13
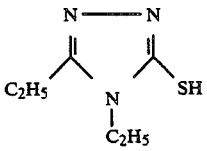
-continued
A-14
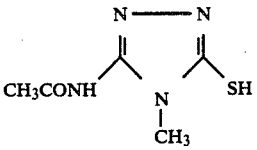
A-15
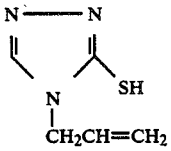
A-16
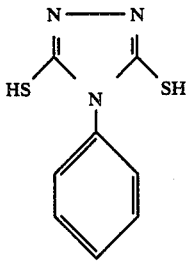
A-17
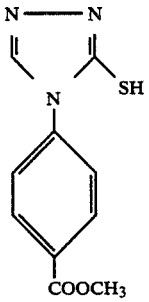
A-18
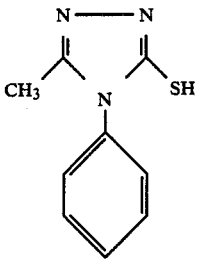
A-19
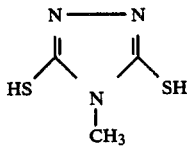
A-20
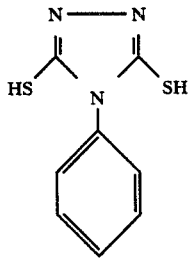

-continued
A-21
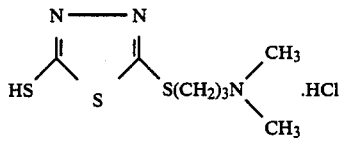
A-22
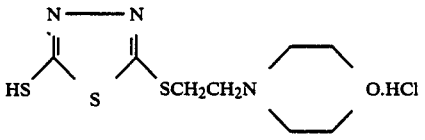
A-23
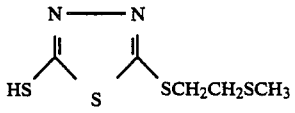
A-24
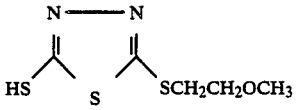
A-25
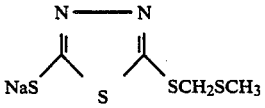
A-26
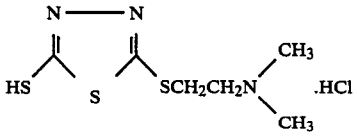
A-27
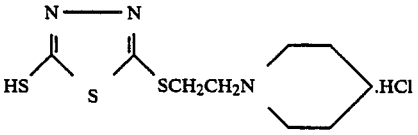
A-28
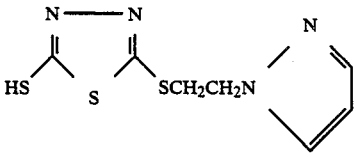
A-29
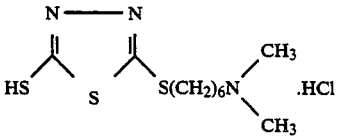
A-30
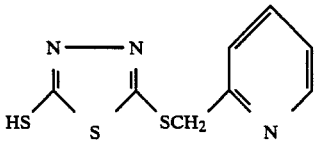
A-31
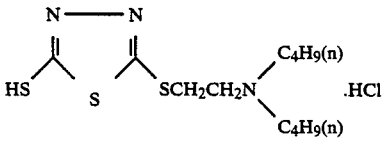
-continued
A-32
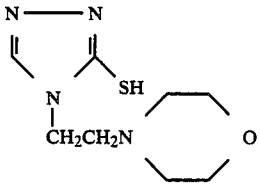
A-33
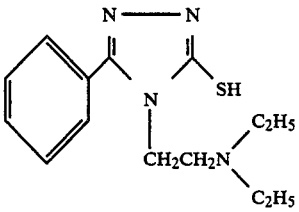
A-34
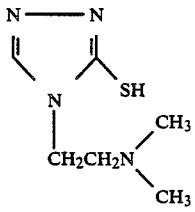
A-35
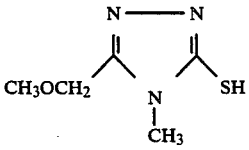
A-36
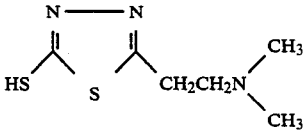
A-37
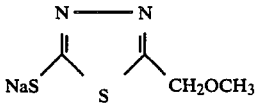
A-38
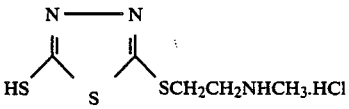
A-39
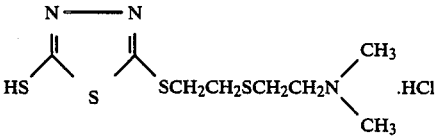
A-40
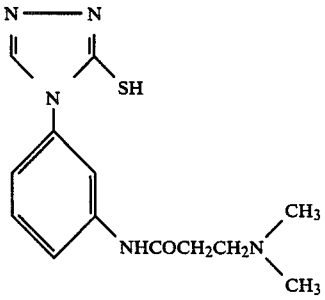

-continued

A-41

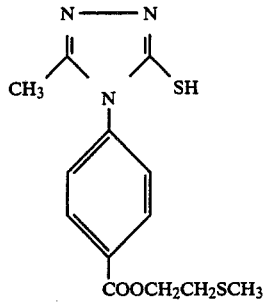

A-42

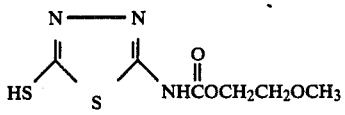

A-43

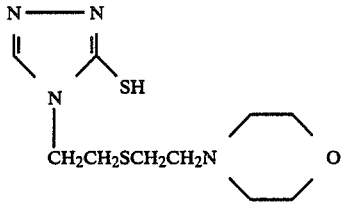

A-44

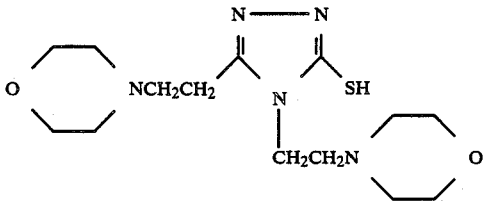

A-45

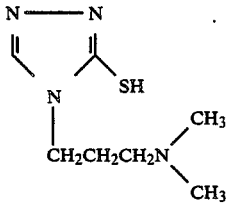

A-46

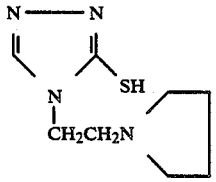

A-47

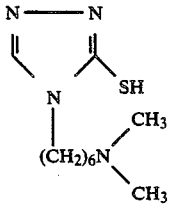

-continued

A-48

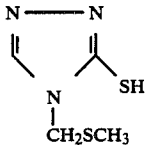

The nucleation-promoting agent may be contained in a light-sensitive material or in a processing solution, and preferably in a light-sensitive material, particularly in an internal latent image type silver halide emulsion or other hydrophilic colloid layer such as an intermediate layer and a protective layer, and most desirably in the silver halide emulsion or an adjacent layer thereof.

Amount of the nucleation-promoting agent to be added is preferably $10^{-6}$ to $10^{-2}$ mol, and particularly $10^{-5}$ to $10^{-2}$ mol per 1 mol of silver halide.

Further, when the nucleation-promoting agent is added to a processing solution, i.e. a developing solution or its pre-bath, the amount is preferably $10^{-8}$ to $-10^{-3}$ mol and particularly $10^{-7}$ to $10^{-4}$ mol per one liter of the solution.

Further, two or more kinds of nucleation-promoting agents may be used together.

In the present invention, various color couplers may be used for forming a direct positive color image. Useful color of these cyan, mazenta and yellow couplers as usable in the present invention are disclosed in the patents cited in Research Disclosure No. 17,643 (published in December, 1978) item VII-D and ibid. No. 18,717 (published in November, 1979).

Typical yellow couplers as preferably usable in the present invention are 2-equivalent yellow couplers of oxygen atom coupling-off type or nitrogen atom coupling-off type. Above all, α-pivaloylacetanilide couplers are excellent in fastness, especially light fastness of formed dyes, and α-benzoylacetanilide couplers give high color density, and thus these are preferable.

5-Pyrazolone magenta couplers as preferably used in the present invention are 5-pyrazolone type couplers wherein the 3-position is substituted with an arylamino group or an acylamino group (especially, 2-equivalent couplers of sulfur atom coupling-off type).

Particularly preferred are pyrazoloazole type couplers, especially pyrazolo(5,1-C)(1,2,4)triazoles, and from the point of a little sub-absorption and light fastness, imidazo(1,2-b)pyrazoles as disclosed in U.S. Pat. No. 4,500,630 are especially preferable and pyrazolo(1,5-b)(1,2,4)triazoles as disclosed in U.S. Pat. No. 4,540,654 are best.

Cyan couplers as preferably used in the present invention are phenol type cyan couplers having an alkyl group containing more than one carbon atom at a meta-position of the phenol nucleus as disclosed in U.S. Pat. No. 3,772,002. Further, 2,5-diacylamino substituted phenol type couplers are also preferable in view of color fastness.

In the present invention, epecially Process I, colored couplers for correcting unwanted absorption which the formed dyes have in short wave length region; couplers that the formed dyes have appropriate diffusibility; non-color forming couplers, DIR couplers which release a development-restraining agent upon coupling reaction, couplers which releases a development-promoting agent upon coupling reaction, and polymerized couplers may also be used.

Typical amount of the color couplers used is in the range of 0.001 to 1 moles per mole of light-sensitive silver halide, preferably 0.01 to 0.5 moles for yellow couplers, 0.003 to 0.3 moles for maganta couplers and 0.002 to 0.3 moles for cyan couplers.

Light-sensitive materials used in the present invention may contain, as an anticolorfoggant or a color mixing inhibitor, hydroquinone derivatives, aminophenol derivatives, amines, gallic acid derivatives, catechol derivatives, ascorbic acid derivatives, colorless compound forming couplers, sulfonamidophenol derivatives, etc.

Light-sensitive materials used in the present invention may also contain various decoloration-preventing agents. Typical organic decoloration-preventing agents include hydroquinones, 6-hydroxychromans, 5-hydroxcoumaranes, spirochromans, p-alkoxyphenols, hindered phenols such as mainly bisphenols, gallic acid derivatives, methylenedioxybenzenes, aminophenols, hindered amines, and ether or ester derivatives of these compounds obtained by silylation or alkylation of a phenolic hydroxl group of them. Further, metal complexes represented by a (bissalicylaldoxymato) nickel complex and a (bis-N,N-dialkyldithiocarbamato) nickel complex may also be used.

Compounds having both partial structures of hindered amine and hindered phenol such as those disclosed in U.S. Pat. No. 4,268,593 give good results for prevention of deterioration of yellow dye images by heat, humidity and light. Further, for prevention of deterioration, especially deterioration by light of magenta dye images, spiroindanes disclosed in Japanese Published Unexamined Patent Application No. 159644/1981 and chromans substituted with hydroquinone diether or monoether give preferred results. These compounds are emulsified together with color couplers respectively corresponding thereto usually in an amount of 5 to 100 wt.% based on the couplers, and added to the light-sensitive layers, whereby the desired purpose can be attained. For prevention of deterioration of cyan dye images by heat and light, especially by light, it is effective to introduce a UV absorbant in the layers of both sides adjacent to cyan color forming layer. Further, the UV absorbant can also be added to a hydrophilic colloidal layer such as a protective layer.

Advantageous bonding agent or protective colloid as can be used in an emulsion layer or an intermediate layer of light-sensitive materials of the present invention is gellatin, but other hydrophilic colloid can also be used.

Light-sensitive materials of the present invention may contain dyes for prevention of irradiation or halation, plasticizers, fluorescent whiteners, matting agent, aerial fogging-preventing agent, coating aids, hardening agents, antistatic agents, sliding property-improving agents, etc. Typical examples of these agents are disclosed in Research Disclosure No. 17,643 (published in December, 1978) and ibid. 18716 (published in November, 1979).

The present invention can be applied to multi-layered multi-color photographic materials having at least two different spectral sensitivity on a support. Multi-layered color photographic materials generally have at least one of each layers of red-sensitive emulsion layers, green-sensitive emulsion layers and blue-sensitive emulsion layers, on a support. The order of these layers can be determined freely according to the necessity. Preferred order of the layer arrangement is red-sensitive, green-sensitive and blue-sensitive from the support side, green-sensitive, red-sensitive and blue-sensitive from the support side, or blue-sensitive, red-sensitive and green-sensitive from the support side. The afore-mentioned each emulsion layer may consists of two or more different emulsion layers, or a non-light-sensitive layer may exist between two or more emulsion layers having the same sensitivity. Usually, cyan-forming couplers, magenta-forming couplers and yellow-forming couplers are respectively introduced in the red-sensitive emulsion layer, green-sensitive emulsion layer and blue-sensitive emulsion layer, but other combination is possible, if necessary.

It is preferable to provide in addition to the silver halide emulsion layers in the light-sensive materials of the present invention in auxiliary layer such as a protective layer, an intermediate layer, a filter layer, an antihalation layer, a back layer and a white-reflecting layer according to the necessity.

In photographic light-sensitive materials of the present invention, photographic emulsion layer and the other layers are coated on a flexible support such as plastic films, papers, cloths, etc. as usually used in photographic light-sensitive materials, or on a rigid substrate such as glasses, chinas, metals, etc. Useful flexible supports include films consisting of semi-synthetic or synthetic polymers such as cellulose nitrate, cellulose acetate, cellulose acetate butyrate, polystyrene, polyvinyl chloride, polyethylene terephthalate, polycarbonate, etc.; baryta layers; or papers wherein a α-olefin polymer (such as polyethylene, polypropylene, a copolymer of ethylene/butane), etc. is coated or laminated thereon. The support may be colored with a dye or pigment. The support may be blackened for the purpose of light-shielding. The surface of these supports is in general undercoated for improving adhesiveness with the photographic emulsion layers, etc. The support surface may be treated by glow discharge, corona discharge, UV irradiation, flame treatment, etc. before or after the undercoating.

Coating of the silver halide photographic emulsion layers and the other hydrophilic colloidal layers can be conducted according to various known method such as a dip coating method, a roller coating method, a certain coating method, an extrusion coating method, etc.

The present invention is applicable to various color light-sensitive materials, typically for example, color reversal films and color reversal papers for slides or televisions, etc. The present invention can also be applied to color hard copy for preserving images of full color copying machines or CRT. The present invention can also be applied to black-and-white light-sensitive materials which are utilizing mixing of couplers of these colors and disclosed in Research Disclosure No. 17123 (published in July, 1978) and the like.

The color developing solution used in the developing process of the light-sensitive materials of the present invention is a so-called surface developer, which does not substantially contain a solvent for silver halide, and is preferably an aqueous alkaline solution of pH 11.5 or less, especially in Process II preferably pH 9.5 to 11.3 and particularly pH 9.8 to 10.9, containing an aromatic primary amine type color developing agent as a main component. The phrase "not substantially contain a solvent for silver halide" means that the surface developer may contain a small amount of a solvent for silver halide so long as it does not spoil the purpose of the invention. As the aromatic primary amine type color developing agent, a p-phenylenediamine type color developing agent is ordinarily used. As the typical examples thereof, 3-methyl-4-amino-N,N-diethylaniline, 3-methyl-4-amino-N-ethyl-N-β-hydroxyethylaniline, 3-methyl-4-amino-N-ethyl-N-β-methane-sulfoamidoethylaniline, 3-methyl-4-amino-N-ethyl-N-β-methoxyethylaniline, and sulfate, hydrochloride, phosphate, p-toluenesulfonate, tetraphenylborate, p-(t-octyl)benzenesulfonic acid, etc. of these compounds, etc. are mentioned. These diamines are more stable in a salt state than in a free state in general.

The color developing agent is generally used in a concentration of about 0.1 g to about 30 g, preferably about 1 g to about 15 g per 1 l of the color developing solution.

Further, with respect to the color developing solution, it is also possible to decrease the amount of a replenisher by using an auxiliary solution wherein the concentration of the halide, color developing agent, etc. is adjusted.

Color developing process of the present invention is usually carried out for a time of 5 minutes or less, preferably for a time of 2 minutes and 30 seconds or less for promotion of the process. Preferred processing time is 30 seconds—2 minutes. Generally, it is better that the color developing is carried out in a shorter time, so long as the adequate color density is obtained.

From the viewpoint of prevention of pollution, ease of preparing the color developing solution, and improvement of preservation and stability of the solution, it is preferred that the color developing solution used in the present invention does not contain benzyl alcohol substantially. In this connection, the phrase "does not contain benzyl alcohol substantially" means that a benzyl alcohol is contained in a concentration of 2 ml/l or less, preferably 0.5 ml/l or less, and particularly is not contained at all.

The silver halide light-sensitive material of the present invention may contain color developing agents or precursors thereof in view of simplification and rapidity of the process. In this connection, the precursors are preferred in view of increase of stability of the light-sensitive material. Specific examples of such developing agent precursors are indoaniline compounds, Schiff base-type compounds, aldol compounds, urethane compounds, etc.

The silver halide color light-sensitive materials of the present invention may contain various 1-phenyl-3-pyrazolidones for promotion of color development.

The color developing solution of the present invention may contain a pH buffer, preservative, or metal chelate compound disclosed in pages 14 to 22 of the specification of Japanese Patent Application No. 23462/1986. Further, a halide ion such as a bromide ion, an iodide ion, etc. and competing couplers such as citrazinic acid may be contained tehrein.

The photographic emulsion layers after the color development are usually subjected to bleaching treatment. The bleaching treatment can be carried out by simple bath bleach-fixing (blix) where bleaching and fixing are simultaneously carried out, or by (bleaching and fixing) treatment. In view of rapidity of the treatment, either a method where the bleach-fixing treatment is conducted after the bleaching treatment, or a method where the bleach-fixing treatment is conducted after the fixing treatment can also be adopted.

As the bleaching agents used for the bleaching treatment or bleach-fixing treatment, organic complex salts of iron (III) and persulfate are preferable in view of rapid treatment and environmental pollution.

As the organic complex salts of iron (III), iron (III) complex salts of ethylenediaminetetraacetic acid, diethylenetriaminepentaacetic acid, cyclohexanediaminetetraacetic acid, 1,2-diaminopropanetetraacetic acid, methyliminodiacetic acid, 1-3-diaminopropanetetraacetic acid, glycoletherdiaminetetraacetic acid are preferable as they have high bleaching abilities.

Preferred persulfates include alkali metal persulfates such as potassium persulfate, sodium persulfate, etc.; ammonium persulfate and the like.

The amount of the bleaching agent used per 1 l of the bleaching solution is properly 0.1 to 2 moles. Preferred pH range of the bleaching solution is 0.5 to 8.0 in case of ferric ion complex salts, especially 4.0 to 7.0 in case of ferric ion complex salts of aminopolycarboxylic acids, aminopolyphosphonic acids, phosphonocarboxylic acids and organic phosphonic acids. When persulfate salts are used, the concentration of 0.1 to 2 moles/l and the pH range of 1 to 5 are preferable.

Fixing agents used for the fixing or bleach-fixing are known fixing agents, and include water-soluble silver halide-dissolving agents, for example thiosulfate such as sodium thiosulfate and ammonium thiosulfate; thiocyanate such as sodium thiocyanate and ammonium thiocyanate; thioether compounds such as ethylenebisthioglycolic acid and 3,6-dithia-1,8-octanediol; thioureas and the like. These fixing agents can be used alone or in combination.

In case of the fixing treatment or bleach-fixing treatment, fixing agent is preferably used in a concentration of 0.2 to 4 moles/l. In case of the bleach-fixing treatment, preferably ferric ion complex salt and fixing agent are used in a concentration of 0.1 to 2 moles and 0.2 to 4 moles per 1 l of the bleach-fixing solution, respectively. The preferred pH range of the fixing or bleach-fixing solution is usually 4.0 to 9.0, especially 5.0 to 8.0.

The fixing solution or bleach-fixing solution may contain, in addition to the aforesaid additive agents as can be added to the bleaching solution, preservatives such as sulfites (e.g., sodium sulfite, potassium sulfite, ammonium sulfite), bisulfites, hydroxylamine, hydrazine, bisulfite addition aldehyde compounds (e.g., acetaldehyde sodium bisulfite), etc. Further, various fluorescent whiteners, defoaming agents, surfactants and organic solvents such as polyvinylpyrrolidone and methanol may be contained therein.

Bleach accelerators can be used, if necessary, in the bleaching solution, bleach-fixing solution are pre-baths of them. Specific examples of the useful bleach accelerators are compounds having a mercapto group or a disulfido group, thiazolidine derivatives, thiourea derivatives, iodide, polyethylene oxides, polyamines, etc. Further, the compounds disclosed in Japanese Published Unexamined Patent Application Nos. 42434/1974, 59644/1974, 94927/1978, 35727/1979, 26506/1980 and 163940/1983 and iodide and bromide ions may also be used therefor. Above all, the compounds having a mercapto group or disulfido group are preferable in view of strong accelerating effect, and especially the compounds as disclosed in U.S. Pat. No. 3,893,858, West German Patent No. 1,290,812 and Japanese Published Unexamined Patent Application No. 95630/1978 are preferable. Further, the compounds disclosed in U.S. Pat. No. 4,552,834 are also preferable. These bleach accelerators may be added to the light-sensitive materials.

Processing steps such as water washing and stabilizing process are generally carried out after the fixing step or bleach-fixing step.

In the water washing step or stabilizing step, various known compounds may be used for prevention of precipitation and stabilization of washing water. For example, inorganic phosphoric acid; chelating agents such as aminopolycarboxylic acids and organic phosphonic acids; bacteriocides or antimold agents (for example, the compounds disclosed in J. Antibact. Antifung. Agents vol. 11, No. 5, p 207–223 (1983) and the compounds disclosed in "Boukin Boubai no Kagaku" (Chemistry for antibacterial and antifungal purpose) written by Hiroshi Horiguchi); metal salts represented by magnesium salts, aluminum salts and bismuth salts; alkali metal salts; ammonium salts, surfactants for preventing load for dying and unevenness; etc. may be added, if necessary. The compounds disclosed "Phot. Sci. Eng." written by L. E. West, vol. 6, pages 344–359 (1965), etc. may also be added. Addition of a chelating agent, a bacteriocide or an antimold is especially effective.

The water washing process is usually carried out in a multi-step counterflow manner consisting of 2 or more baths (e.g. 2 to 9 baths) to save the amount of washing water. Otherwise, multi-step counterflow stabilization process as disclosed in Japanese Published Unexamined Patent Application No. 8543/1982 may be carried out instead of the water washing process. In the stabilizing bath, various compounds other than the aforesaid additives are added for the purpose of stabilizing the image. For instance, various buffers for adjusting the pH of the membrane (e.g., to pH 3 to 9) such as borates, metaborates, borax, phosphates, carbonates, potassium hydroxide, sodium hydroxide, aqueous ammonia, monocarboxylic acids, dicarboxylic acids and polycarboxylic acids in combination, and aldehydes such as formalin are mentioned as typical examples. In addition, various additives such as chelating agents (e.g., inorganic phosphoric acid, aminopolycarboxylic acids, organic phosphonic acids, aminopolyphosphonic acids and hosphonocarboxylic acid), bacteriocides, antimolds (e.g., thiazoles, isothiazoles, halogenated phenols, sulfanylamide and benzotriazole); surfactants, fluorescent whiteners and hardening metal salts may also be used. Two or more of these compounds for the same or different purpose may be used in combination.

Further, addition of various ammonium salts such as ammonium chloride, ammonium nitrate, ammonium sulfate, ammonium phosphate, ammonium sulfite and ammonium thiosulate as a pH adjusting agent after the processing is preferred for improving preservability of the image.

The period of time of the water washing and the stabilization according to the present invention depend upon a type of light-sensitive materials to be processed and process conditions, and is usually 20 seconds to 10 minutes, preferably 20 seconds to 5 minutes.

Each of the process solutions is used at a temperature of from 10° to 50° C., typically from 33° to 38° C. However, a higher temperature may be used to facilitate the process and to shorten the time period of the process. In contrast, a lower temperature may also be used to improve the quality of the image and the stability of the processing solution.

Further, if necessary, each of the time periods of the processes may be shortened for quickening the processing in a range where no serious disadvantage takes place.

In case of a continuous process, a replenisher of each processing solution is used to prevent changes in the composition of the solution, whereby constant finished properties are obtained.

Each treatment bath may be provided with a heater, temperature sensor, level sensor, circulation pump, filter, various floating covers, and various squeezees.

Preferred embodiments of the nucleating agents represented by the aforesaid general formulae (I) and (III) are set forth below.

(1) the nucleating agents of the general formula (I) wherein the heterocyclic ring completed by Z is a quinolinium, benzothiazolium, benzimidazolium, pyridinium, acridinium, phenanthridinium or isoquinolinium nucleus, (2) the nucleating agents of the general formula (I) wherein the group promoting adsorption onto the silver halide as represented by $X^1$ is a thioamido group, heterocyclic mercapto group or nitrogen-containing heterocycle which forms imino silver, (3) the nucleating agents of the general formula (I) wherein the heterocyclic ring completed by Z is quinolinium, benzothiazolium or benzimidazolium, (4) the nucleating agents of the general formula (I) wherein the heterocyclic ring completed by Z is quinolinium or benzothiazolium (5) the nucleating agents of the general formula (I) wherein the heterocyclic ring completed by Z is quinolinium (6) the nucleating agents of the general formula (I) wherein $R^1$, $R^2$ or Z has an alkynyl group as a substituent, (7) the nucleating agents of (6) wherein the heterocyclic ring completed by Z is quinolinium (8) the nucleating agents of (7) which have a group promoting adsorption onto the silver halide as represented by $X^1$, (9) the nucleating agents of (8) wherein the group promoting adsorption onto the silver halide is a thioamido group, heterocyclic mercapto group or nitrogen-containing heterocycle which forms imino silver,

(10) the nucleating agents of the general formula (II) wherein the group represented by $G\text{-}R^{22}$ is a formyl group,

(11) the nucleating agents of the general formula (II) wherein $R^{22}$ and $R^{23}$ are hydrogen atoms and the group represented by $G\text{-}R^{22}$ is a formyl group,

(12) the nucleating agents of the general formula (II) wherein $R^{21}$ is an aromatic group having a group promoting adsorption onto silver halide as consisting of a heterocyclic mercapto group or nitrogen-containing heterocycle which forms imino silver as a substituent, or an aromatic group having an ureido group as a substituent.

The invention will further be explained in the following examples, where Example 1 to 3 illustrate Process I and Examples 4 to 13 illustrate Process II.

In practice of Examples 1 to 3, the following emulsions A, B, C, D, E, F, 1, 2 and 3 were prepared.

EMULSION 1

An aqueous potassium bromide solution and an aqueous silver nitrate solution were simultaneously added to an aqueous gelatin solution containing 3,4-dimethyl-1,3-thiazolidine-2-thione is an amount of 0.3 g per 1 mole of silver with vigorous stirring at 75° C. over a period of about 20 minutes to obtain a silver bromide emulsion containing monodispersed octahedral silver bromide grains having an average grain size of 0.4 μm. Sodium thiosulfate and chloroauric acid tetrahydrate were added to the emulsion in an amount of 5 mg per 1 mole of silver, respectively, and the mixture was held at 75° C. for 80 minutes to carry out chemical sensitization process. The thus obtained silver bromide grains were used as core and processed for 40 minutes in the same precipitation environment as in the first process to grow, and finally to obtain a silver bromide emulsion containing monodispersed octahedral core/shell silver bromide grains having an average grain size of 0.7 μm. After the emulsion was washed with water and desalted, there were added sodium thiosulfate and thloroauric acid tetrahydrate in a respective amount of 1.5 mg per 1 mole of silver. The mixture was held at 60° C. for 60 minutes to carry out chemical sensitization process to obtain, an internal latent image type silver halide emulsion 1.

EMULSIONS A, B, C, D AND 2

An aqueous potassium bromide solution and an aqueous silver nitrate solution were simultaneously added to an aqueous gelatin solution containing 3,4-dimethyl-1,3-thiazolidine-2-thione in an amount of 50 mg per 1 mole of silver with vigorous stirring at 75° C. over a period of about 20 minutes to obtain a silver bromide emulsion containing monodispersed octahedral silver bromide grains having an average grain size of 0.5 μm. Sodium thiosulfate and chloroauric acid tetrahydrate in a respective amount of 3 mg and 1 mg per 1 mole of silver were added to the emulsion, and the mixture was held at 75° C. for 80 minutes to carry out chemical sensitization process.

The thus obtained silver bromide grains were used as core. An aqueous solution of potassium bromide and sodium chloride and an aqueous silver nitrate solution were simultaneously added to the emulsions with vigorous stirring at 75° C. over a period of about 30 minutes to obtain an emulsion containing monodispersed silver bromochloride grains having an average grain size of 0.7 μm. The ratio of the amount of silver halide in the core to that in the shell was 38/62.

Samples containing different amounts of silver chloride in the shell the prepared by changing a molar ratio of potassium bromide to sodium chloride.

| | Mol % of AgCl in the shell |
|---|---|
| Emulsion A | 90 |
| B | 70 |
| C | 50 |
| D | 20 |
| 2 | 0 |

EMULSION E

First, 30 g of gelatin was added to 1 l of the mixture containing 0.5 mol/l KBi, 0.2 mol/l NaCl and 0.0015 mol/l KI to make a solution. Then, 700 cc of the solution of 1 mol/l silver nitrate was added to the solution over a period of 20 minutes, and the mixture was allowed to stand for 20 minutes to conduct physical ripening. Then, water soluble halides were removed therefrom by water washing, 20.0 g of gelatin was added thereto and water was added thereto to adjust the whole amount to 1200 cc, an emulsion of silver halide having an average grain size of 0.4 μm (Emulsion-3) was obtained.

Then, 500 cc of 1 mol/l aqueous silver nitrate solution and 500 cc of 2 mol/l aqueous sodium chloride solution were simultaneously added to 300 cc of the emulsion at 60° C. to precipitate silve chloride shell, and then water washing was carried out. The silver halide core/shell emulsion E containing silver halide grains having an average grain size of 0.7 μm.

On the other hand, 500 cc of 1 mol/l aqueous silver nitrate solution and 500 cc of 1.1 mol/l aqueous potassium bromide solution were simultaneously added to 300 cc of the core emulsion-3 at 66° C. to precipitate silver bromide shell, and then water washing was carried out. The silver halide core/shell emulsion-4 containing silver halide grains having an average grain size of 0.7 μm.

EMULSIONS F AND 5

First, 175 ml of 2 mol/l aqueous silver nitrate solution and 175 ml of 2.1 mol/l aqueous sodium chloride solution were simultaneously added to a solution containing 10 g of gelatin at 60° C. over a period of 10 minutes, and the mixture were allowed to stand for 15 minutes to conduct physical ripening. Then, 200 ml of 2 mol/l aqueous potassium bromide solution was added thereto and physical ripening was conducted for 15 minutes. Then, water soluble halides were removed therefrom by water washing, 10 g of gelatin was added thereto, and water was added thereto to make a whole volume to 300 ml. An emulsion containing silver bromochloride grains having an average grain size of 0.3 μm was obtained. Composition analysis of this emulsion 5 revealed that the silver bromochloride contains 94 mol% of silver bromide.

A core/shell emulsion was prepared as follows using the emulsion 5 as core. That is, 100 ml of 2 mol/l aqueous silver nitrate solution and 100 ml of 2.1 mol/l aqueous potassium chloride solution were simultaneously added to 500 ml of the core emulsion, i.e. Emulsion-5 at 60° C. over a period of 5 minutes to precipitate silver chloride shell, and then water washing was carried out. A core/shell silver halide emulsion containing silver halide grains having an average grain size of 0.35 μm and silver chloride shell content is 41 mol% based on the total amount of silver halide (Emulsion F).

EXAMPLE 1

A coating solution prepared according to the following manner was coated on a paper support, both surfaces of which had been laminated with polyethylene, to make color photographic paper Nos. 1 to 6.

(Preparation of the coating solution)

Ethyl acetate and the solvent (c) were mixed with the megenta coupler (a) and the dye image stabilizer (b) contained in a vessel to make a solution which was then emulsified and dispersed in a 10% aqueous gelatin solution containing 10% sodium dodecylbenzenesulfonate. The emulsified dispersion was mixed with the above core/shell type internal latent image silver halide emulsion A, B, C, D, 1 or 2 (they respectively contain a green-sensitive dye and an irradiation dye) to make a solution. Concentrations of the solution were adjusted with gelatin so as to make the composition shown in Table 1. The nucleating agent, i.e. the above-illustrated compound 4 in an amount of $3.9\times10^{-5}$ mol per 1 mol of silver and the nucleation-promoting agent, i.e. the above-illustrated compound 22 in an amount of $4.2\times10^{-4}$ mol per 1 mol of silver were added to the solution to prepare a coating solution.

The coating solution was applied on the polyethylene laminated paper. Simultaneously the ultraviolet ray absorbing layer having the following composition was applied onto the layer and the protective layer having the following composition was further applied onto the ultraviolet ray absorbing layer.

| | |
|---|---|
| UV absorbing layer | |
| Gelatin | 1.68 g/m$^2$ |
| Colloidal silver | 0.10 g/m$^2$ |
| Protective layer | |
| Gelatin | 1.33 g/m$^2$ |
| Acryl modified copolymer of polyvinyl alcohol (Modification degree 17%) | 0.17 g/m$^2$ |

TABLE 1

Composition of the green-sesitive layer

| Main component | Amount used |
|---|---|
| Emulsion A, B, C, D, 1 abd 2 | Silver amount 0.39 g/m$^2$ |
| Gelatin | 1.56 g/m$^2$ |
| Magenta coupler (e) | $4.6\times10^{-4}$ mol/m$^2$ |
| Dye image stabilizer (f) | 0.14 g/m$^2$ |
| Solvent (g) | 0.42 g/m$^2$ |
| Nucleatin agent (The illustrated compound 4) | |
| Nucleation promoting agent (The illustrated compound 22) | |

Green-sensitive dye

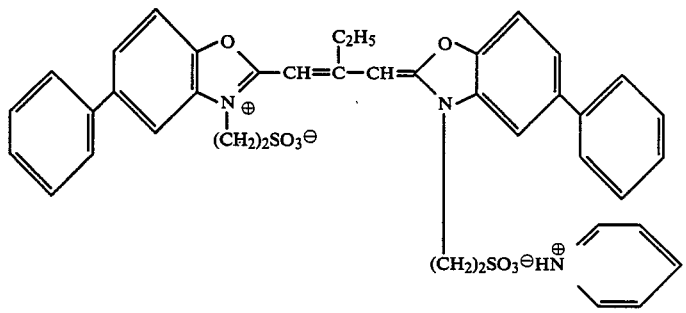

Irradiation-preventing dye for the green-sensitive emulsion layer

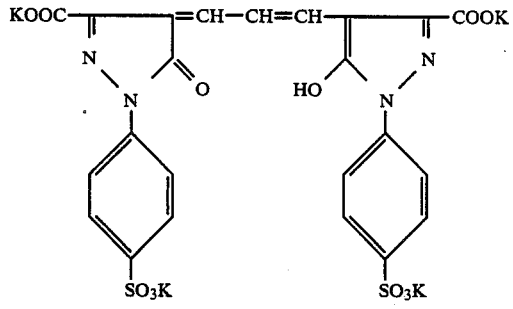

(e)

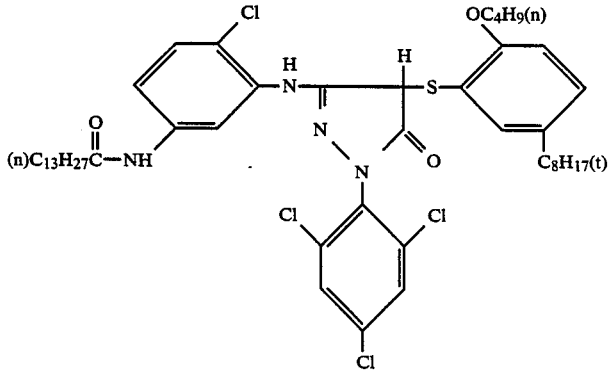

(f)

The mixture of

TABLE 1-continued

Composition of the green-sesitive layer

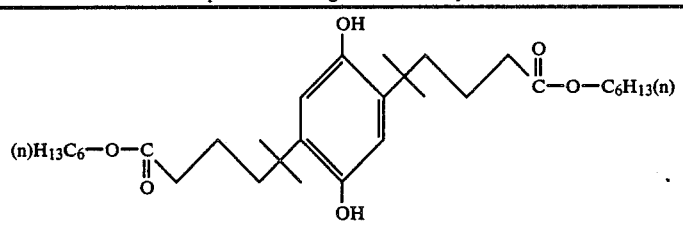

with

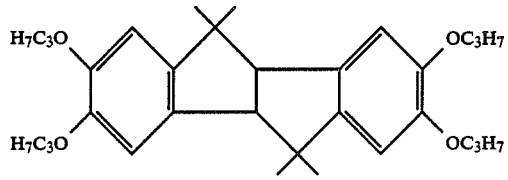

in the ratio of 1:15 (weight ratio)

(g) The mixture of

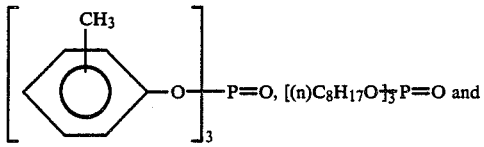

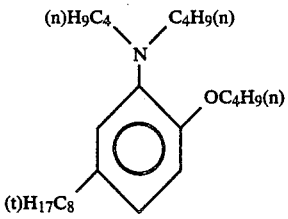

in the ratio of 1:2:2 (weight ratio)

The thus made color photographic papers were exposed to light through an optical wedge (1/10 seconds, 10 CMS) and a green filter (SP-2 manufactured and sold by Fuji Photo Film Co., Ltd.), and then subjected to the following process step A (the pH of the color developing solution was 10.2), B (the pH of the color developing solution was 11.2) or C (the pH of the color developing solution was 12.0). Then, the concentration of the formed magenta image density was measured.

The results obtained are shown in Table 2.

| | Process step A | |
|---|---|---|
| | Time | Temperature |
| Color development | 2 minutes 30 seconds | 33° C. |
| Bleach-fixing | 40 seconds | 33° C. |
| Stabilization (1) | 20 seconds | 33° C. |
| Stabilization (2) | 20 seconds | 33° C. |
| Stabilization (3) | 20 seconds | 33° C. |

The stabilizing process was carried out according to the so-called counterflow replenishment method, in which the replenisher was first introduced to replenished the stabilizing bath (3), the overflowed solution from the stabilizing bath (3) was introduced to the stabilizing bath (2), and the overflowed solution from the stabilizing bath (2) was introduced to the stabilizing bath (1).

| | Mother liquor |
|---|---|
| (Color developing solution) | |
| Diethylenetriaminepentaacetic acid | 2.0 g |
| Benzyl alcohol | 12.8 g |
| Diethylene glycol | 3.4 g |
| Sodium sulfite | 2.0 g |
| Sodium bromide | 0.26 g |
| Hydroxylamine sulfate | 2.60 g |
| Sodium chloride | 3.20 g |
| 3-Methyl-4-amino-N—ethyl-N—(β-methanesulfonamidoethyl) aniline | 4.25 g |
| Potassium carbonate | 30.0 g |
| Fluorescent whitener (stilbene type) | 1.0 g |
| Water to | 1000 ml |
| pH | 10.20 |
| pH was adjusted with potassium hydroxide or hydrochloric acid. | |
| (Formulation of the bleach-fixing solution) | |
| Water | 700 cc |
| Ammonium thiosulfate (54 wt. %) | 150 cc |
| Sodium sulfite | 15 g |
| $NH_4$(Fe(III)(EDTA)) | 55 g |
| EDTA.2NA(dihydrate) | 4 g |
| Glacial acetic acid | 8.61 g |
| Total volume with the addition of water | 1000 cc (pH 5.4) |
| pH was adjusted with ammonia water or hydrochloric acid. | |
| (Stabilizing solution) | |
| 1-Hydroxyethylidene-1,1'-diphosphonic acid (60%) | 1.6 ml |
| Bismuth chloride | 0.35 g |
| Polyvinylpyrrolidone | 0.25 g |
| Ammonia water | 2.5 ml |
| Nitrilotriacetic acid | 1.0 g |

-continued

| | Mother liquor |
|---|---|
| 5-Chloro-2-methyl-4-isothiazolin-3-one | 50 mg |
| 2-Octyl-4-isothiazolin-3-one | 50 mg |
| Fluorescent whitener (4,4'-diaminostilbene type) | 1.0 g |
| With the addition of water | 1000 ml |
| pH | 7.5 |
| pH was adjusted with potassium hydroxide or hydrochloric acid. | |

Process step B was the same as the process step A except that color development time was one minute and 30 seconds and the pH of the developing solution was adjusted to 11.2.

Further, process step C is the same as the process step B except that the pH of the color developing solution was adjusted to 12.0.

The following color developing solution was used in the process steps D, E and F.

| (Formulation of the color developing solution-D) | |
|---|---|
| Water | 800 cc |
| Pentasodium diethylenetriamine-pentaacetate | 1.0 g |
| Sodium sulfite | 0.2 g |
| N,N—diethylhydroxylamine | 4.2 g |
| Potassium bromide | 0.01 g |
| Sodium chloride | 1.5 g |
| Triethanolamine | 8.0 g |
| N—Ethyl-N—(β-methane sulfonamidoethyl)-3-methyl-4-aminoaniline sulfate | 4.5 g |
| Potassium carbonate | 30.0 g |
| 4,4'-Diaminostilbene type fluorescent whitener (Whitex 4 manufactured and sold by Sumitomo Chemical Co., Ltd.) | 2.0 g |
| Total volume with addition of water | 1000 cc (pH 10.2) |

TABLE 2

| | | Benzyl alcohol, Used | | | | | | Benzyl alcohol, Not used | | | | | |
|---|---|---|---|---|---|---|---|---|---|---|---|---|---|
| | | Process Step A | | Process Step B | | Process Step C | | Process Step D | | Process Step E | | Process Step F | |
| No. | Emulsion | $D_{max}$ | $D_{min}$ | $D_{max}$ | $D_{min}$ | $D_{max}$ | $D_{min}$ | $D_{max}$ | $D_{min}$ | $D_{max}$ | $D_{min}$ | $D_{max}$ | $D_{min}$ |
| 1 | A | 2.6 | 0.09 | 2.5 | 0.09 | 2.3 | 0.09 | 2.3 | 0.09 | 2.3 | 0.09 | 2.2 | 0.09 |
| 2 | B | 2.5 | 0.09 | 2.4 | 0.09 | 2.3 | 0.10 | 2.2 | 0.09 | 2.2 | 0.09 | 2.2 | 0.09 |
| 3 | C | 2.6 | 0.09 | 2.5 | 0.09 | 2.3 | 0.10 | 2.2 | 0.09 | 2.3 | 0.09 | 2.1 | 0.09 |
| 4 | D | 2.5 | 0.10 | 2.4 | 0.09 | 2.4 | 0.10 | 2.2 | 0.09 | 2.2 | 0.09 | 2.2 | 0.09 |
| 5 | 1 | 2.4 | 0.09 | 2.5 | 0.09 | 2.3 | 0.10 | 1.7 | 0.09 | 1.9 | 0.09 | 2.1 | 0.10 |
| 6 | 2 | 2.5 | 0.09 | 2.4 | 0.09 | 2.2 | 0.11 | 1.7 | 0.09 | 1.9 | 0.09 | 2.2 | 0.10 |

The lowering of $D_{max}$ in the sample Nos. 1 to 4 using the emulsions A to D, even in the process D where benzyl alcohol was not used was small as compared with the process A where benzyl alcohol was used, whereas the lowering of $D_{max}$ in the comparative example Nos. 5 and 6 was large. Similar result was obtained in the process E where benzyl alcohol was not used as compared with the process B where benzyl alcohol was used. However, with respect to the process C and F where the pH of the developing solution was 12.0, there was not so large difference between Nos. 1 to 4 of the present invention and Nos. 5 and 6 of the comparative example, and the lowering of $D_{max}$ in both cases was small.

EXAMPLE 2

A panchromatic multilayer photographic paper having the layer construction shown in Table 3-1 was made using a paper support, both surfaces of which had been laminated with polyethylene and using the core/shell type internal latent image emulsion A, D, 2, E, F or 5. The coating solution was prepared according to the following manner.

Preparation of the first coating solution: First, 10 ml of ethyl acetate and 4 ml of the solvent (c) were added to 10 g of the cyan coupler (a) and 2.3 g of the dye image stabilizer (b) to make a solution which was then emulsified and dispersed in 90 ml of a 10% aqueous gelatin solution containing 5 ml of a 10% sodium dodecylbenzenesulfonate solution. On the other hand, 90 g of a red-sensitive emulsion was prepared by adding the red-sensitive dye illustrated below to the above silver halide emulsions A, D, 2, E, F or 5 (each containing 70 g of Ag per Kg) in an amount of $2.0\times10^{-4}$ mol per 1 mol of silver halide. The emulsified dispersion and the emulsion were mixed to make a solution. The concentration of the solution was adjusted with gelatin so as to make the composition shown in Table 3-1. Then, the nucleating agent, i.e. the compound 50 in an amount of $4.0\times10^{-5}$ mol per 1 mol of Ag and the nucleation-promoting agent, i.e. the compound 32 in an amount of $3.0\times10^{-4}$ mol per 1 mol of Ag were added thereto to prepare the coating solution for the first layer.

The coating solutions for the second to seventh layers were respectively prepared in the same manner as that for the first layer coating solution. 1-Oxy-3,5-dichloro-s-triazine sodium salt was used as a gelatin-hardening agent of each layer.

The following were used as a spectral sensitizer of each emulsion.

The magenta coupler (e), the dye image stabilizer (f), the solvent (g) and green-sensitive sensitizing dye. The irradiation-preventing dye was the same as that disclosed in Example 1. Other additives are as follows.

Blue-sensitive emulsion layer:

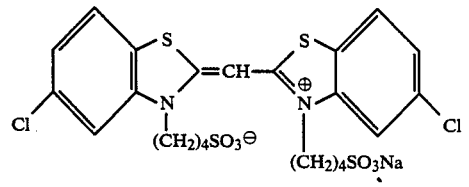

Red-sensitive emulsion layer:

-continued
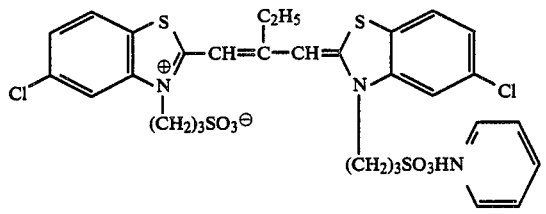
The following dye was used as the irradiation-preventing dye for the red-sensitive emulsion layer.
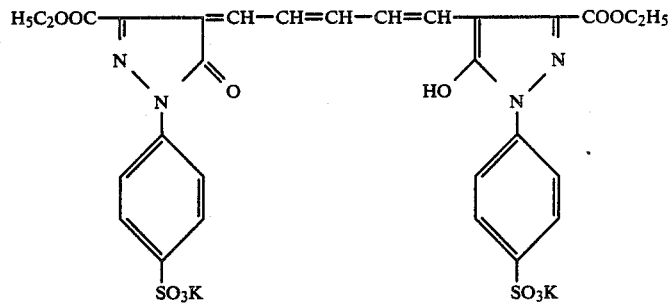
Chemical structures of the compounds such as couplers used in the present example are as follows:
(k) Yellow coupler
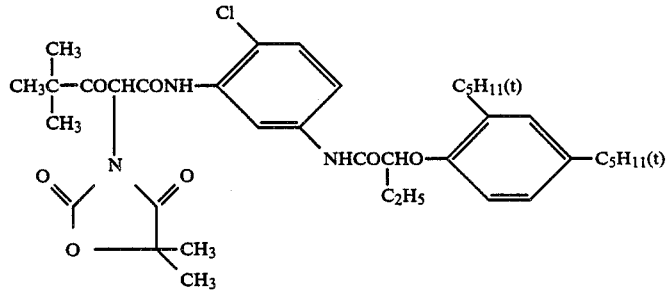
(l) Dye image-stabilizing agent
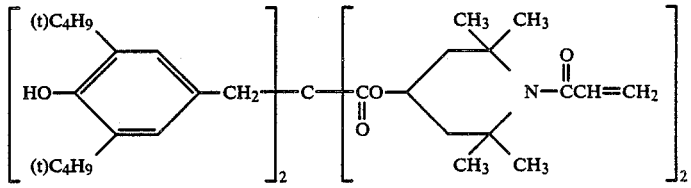
(m) Solvent
$(iso C_9H_{19}O)_3P{=}O$
(h) Ultraviolet ray absorbing agent
The mixture of
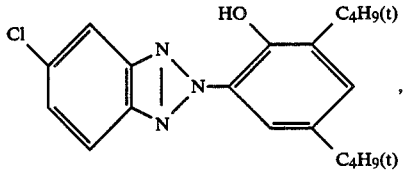
,
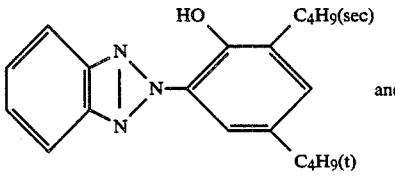
and -continued

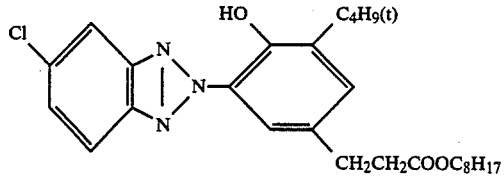

in the ratio of 1:5:3 (molar ratio)

(i) Color mixing inhibitor

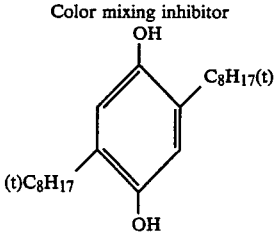

(j) Solvent $(isoC_9H_{19}O)_3P{=}O$ (a) Cyan coupler

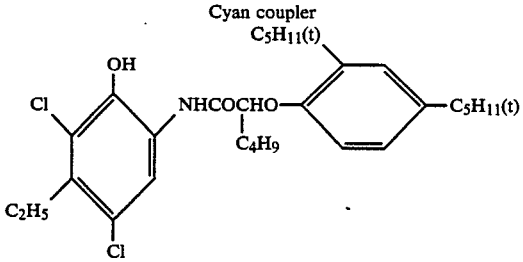

(b) Dye image stabilizer

The mixture of

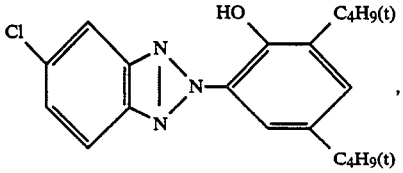

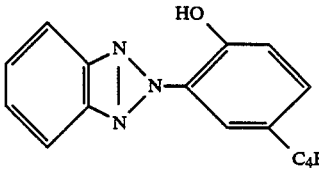

and

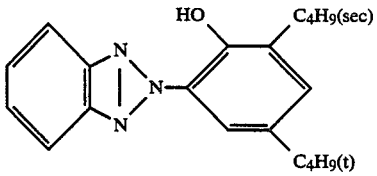

in the ratio of 1:3:3 (molar ratio)

(c) Solvent

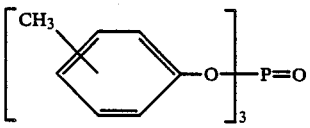

(d) Color mixing inhibitor

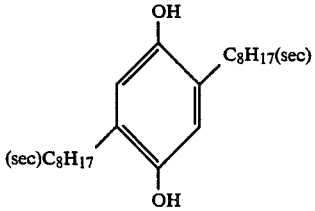

The coating solutions for the first to seventh layers were simultaneously applied after the surface tension and viscosity balance thereof were adjusted to make a panchromatic multilayer photographic paper.

The thus obtained color photographic paper Nos. 1 to 6 were respectively subjected to exposure to light and development process in the same condition as in Example 1. The results obtained with respect to the formed magenta image are shown in Table 3-2.

TABLE 3-1

| Layer | Main component | Amount used |
|---|---|---|
| The 7th layer (Protective layer) | Gelatin | 1.33 g/m$^2$ |
| | Polymethyl methacrylate latex particles (average diameter 2.8μ) | 0.05 g/m$^2$ |
| | Acryl modified copolymer of polyvinyl alcohol (Modification degree 17%) | 0.17 g/m$^2$ |
| The 6th layer (UV absorbing layer) | Gelatin | 0.54 g/m$^2$ |
| | UV absorbent (h) | $5.10 \times 10^{-4}$ mol/m$^2$ |
| | Solvent (j) | 0.08 g/m$^2$ |
| The 5th layer (Blue-sensitive layer) | Emulsion silver: | 0.40 g/m$^2$ |
| | Gelatin | 1.35 g/m$^2$ |
| | Yellow coupler (k) | $6.91 \times 10^{-4}$ mol/m$^2$ |
| | Dye image stabilizer (l) | 0.13 g/m$^2$ |
| | Solvent (g) | 0.02 g/m$^2$ |
| | Nucleating agent and Nucleation-promoting agent | |
| The 4th layer (UV absorbing layer) | Gelatin | 1.60 g/m$^2$ |
| | Colloidal silver | 0.10 g/m$^2$ |
| | UV absorbent (h) | $1.70 \times 10^{-4}$ mol/m$^2$ |
| | Color mixing inhibitor (i) | $1.60 \times 10^{-4}$ mol/m$^2$ |
| | Solvent (j) | 0.24 g/m$^2$ |
| The 3rd layer (Green-sensitive layer) | Emulsion silver: | 0.39 g/m$^2$ |
| | Gelatin | 1.56 g/m$^2$ |
| | Magenta coupler (e) | $4.60 \times 10^{-4}$ mol/m$^2$ |
| | Dye image stabilizer (f) | 0.14 g/m$^2$ |
| | Solvent (g) | 0.42 g/m$^2$ |
| | Nucleating agent and Nucleation-promoting agent | |
| The 2nd layer (Inter layer) | Gelatin | 0.90 g/m$^2$ |
| | Color mixing inhibitor (d) | $2.33 \times 10^{-4}$ mol/m$^2$ |
| The 1st layer (Red-sensitive layer) | Emulsion silver: | 0.39 g/m$^2$ |
| | Gelatin | 0.90 g/m$^2$ |
| | Cyan coupler (a) | $7.05 \times 10^{-4}$ mol/m$^2$ |
| | Dye image stabilizer (b) | $5.20 \times 10^{-4}$ mol/m$^2$ |
| | Solvent (c) | 0.22 g/m$^2$ |
| | Nucleating agent and Nucleation-promoting agent | |
| Support | Polyethylene laminated paper (white pigment ($TiO_2$, etc.) and bluish dye (ultramarine, etc.) are contained in the polyethyle in the first layer side) | |
| Back layer | Gelatin | 5.40 g/m$^2$ |

TABLE 3-2

| | | Benzyl alcohol, Used | | | | | | Benzyl alcohol, Not used | | | | | |
|---|---|---|---|---|---|---|---|---|---|---|---|---|---|
| | | Process Step A | | Process Step B | | Process Step C | | Process Step D | | Process Step E | | Process Step F | |
| No. | Emulsion | $D_{max}$ | $D_{min}$ | $D_{max}$ | $D_{min}$ | $D_{max}$ | $D_{min}$ | $D_{max}$ | $D_{min}$ | $D_{max}$ | $D_{min}$ | $D_{max}$ | $D_{min}$ |
| 1 | A | 2.4 | 0.09 | 2.5 | 0.09 | 2.3 | 0.09 | 2.3 | 0.09 | 2.3 | 0.09 | 2.2 | 0.09 |
| 2 | D | 2.5 | 0.09 | 2.6 | 0.09 | 2.4 | 0.09 | 2.3 | 0.09 | 2.3 | 0.09 | 2.2 | 0.09 |
| 3 | E | 2.5 | 0.09 | 2.6 | 0.09 | 2.3 | 0.09 | 2.2 | 0.09 | 2.3 | 0.09 | 2.1 | 0.09 |
| 4 | F | 2.4 | 0.09 | 2.5 | 0.09 | 2.4 | 0.09 | 2.3 | 0.09 | 2.2 | 0.09 | 2.2 | 0.09 |
| 5 | 2 | 2.4 | 0.09 | 2.5 | 0.09 | 2.4 | 0.09 | 1.7 | 0.09 | 1.9 | 0.09 | 2.1 | 0.09 |
| 6 | 5 | 2.5 | 0.09 | 2.6 | 0.09 | 2.3 | 0.09 | 1.6 | 0.09 | 1.9 | 0.09 | 2.2 | 0.09 |

As apparent from the results in Table 3, the effects similar to those obtained in Example 1 were also obtained in the panchromatic multilayer photographic paper series where the red-sensitive emulsion layer, green-sensitive emulsion layer and blue-sensitive emulsion layer were applied.

EXAMPLE 3

The emulsions were used in the same manner as described in Table 4, and the same procedure as in Example 2 was applied except of the nucleating agent and the nucleation-promoting agent, to make color photographic papers.

The individual color photographic paper was exposed to light and processed according to the process steps A and D with the exception that the temperature used was 38° C. and the color development time was one minute and 40 seconds. In the processing, light of 0.5 lux (color temperature 5400 K) was irradiated for 10 seconds from 15 seconds from the beginning of the development. Cyan color density of the thus treated samples was measured. The results are shown in Table 4.

TABLE 4

| | | Process step A | | Process step D | |
|---|---|---|---|---|---|
| No. | Emulsion | $D_{max}$ | $D_{min}$ | $D_{max}$ | $D_{min}$ |
| 1 | A | 2.6 | 0.09 | 2.3 | 0.09 |
| 2 | B | 2.6 | 0.09 | 2.3 | 0.09 |
| 3 | C | 2.6 | 0.09 | 2.3 | 0.09 |
| 4 | D | 2.5 | 0.09 | 2.3 | 0.09 |
| 5 | 2 | 2.5 | 0.09 | 1.9 | 0.09 |

Similar results as in Example 1 were obtained.

It is seen that the lowering of $D_{max}$ was not so large in the examples of the present invention where the emulsions A to D were used, even in the processes where benzyl alcohol was not used. In contrast, the lowering of $D_{max}$ was remarkable in the process where benzyl alcohol was not used, in the comparative examples where the emulsion 2 was used.

EXAMPLES 4 TO 7 AND COMPARATIVE EXAMPLE (1)

Preparation of emulsions (1) Emulsion 4

An aqueous potassium bromide solution and an aqueous silver nitrate solution were simultaneously added to an aqueous gelatin solution containing 3,4-dimethyl-1,3-thiazolidin-2-thione in an amount of 0.3 g per 1 mol of AgI with vigorous stirring at 75° C. over a period of about 20 minutes to obtain a silver bromide emulsion containing octahedral monodispersed silver bromide grains having an average grain size of 0.4 μm.

There were added to the emulsion sodium thiosulfate and chloroauric acid tetrahydrate in an amount of 3 mg and 1 mg per 1 mole of silver respectively, and the mixture was held at 75° C. for 80 minutes to carry out chemical sensitization process. The thus obtained bromide grains were used as core and processed for 40 minutes in the same precipitation environment as in the first process to grow and finally to obtain a silver bromide emulsion containing octahedral core/shell silver bromide grains having an average grain size of 0.7 μm. After the emulsion was washed with water and desalted, there were added sodium thiosulfate in an amount of 1.5 mg per 1 mole of silver. The mixture was held at 60° C. for 60 minutes to carry out chemical sensitization process to obtain an internal latent image type silver halide emulsion 4.

EMULSIONS G TO J AND 5

An aqueous potassium bromide solution and an aqueous silver nitrate solution were simultaneously added to an aqueous gelatin solution containing 3,4-dimethyl-1,3-thiazolidine-2-thione in an amount of 0.3 g per 1 mole of silver with vigorous stirring at 75° C. over a period of about 20 minutes to obtain a silver bromide emulsion containing monodispersed octahedral silver bromide grains having an average grain size of 0.5 μm. Sodium thiosulfate and chloroauric acid tetrahydrate in a respective amount of 3 mg and 1 mg per 1 mole of silver were added to the emulsion, and the mixture was held at 75° C. for 80 minutes to carry out chemical sensitization process.

The thus obtained silver bromide grains were used as core. An aqueous solution containing both potassium bromide and sodium chloride or an aqueous solution containing only potassium bromide, and an aqueous silver nitrate solution were simultaneously added to the emulsion with vigorous stirring at 75° C. over a period of about 30 minutes to obtain an emulsion containing monodispersed silver bromochloride or silver bromide grains having an average grain size of 0.7 μm. The ratio of the amount of silver halide in the core to that in the shell was 38/62.

Emulsions G to J and 5 wherein the silver chloride contents in teh shell were changed as follows were prepared by changing the molar ratio of potassium bromide to sodium chloride.

| Emulsion | mol % of AgCl in the shell |
|---|---|
| G | 90 |
| H | 70 |
| I | 50 |
| J | 20 |
| 5 | 0 |

(2)

Making of a color photographic paper

Ethyl acetate and the solvent (g) were mixed with the magenta coupler (e) and the dye image stabilizer (f) contained in a vessel to make a solution which was then emulsified and dispersed in a 10% aqueous gelatin solution containing 10% sodium dodecylbenzenesulfonate. The emulsified dispersion and the aforementioned core/shell type internal latent image silver halide emulsion G, H, I, J, 4 or 5 (respectively containing a green-sensitive dye and an irradiation dye) were respectively mixed to make a solution. The concentration of the solution was adjusted with gelatin so as to make the composition shown in Table 5. Further, the nucleating agent, i.e. the compound 71 and the nucleation-promoting agent disclosed in Table 6 were added to the solution respectively in an amount of $3.0\times10^{-5}$ mol and $4.5\times10^{-4}$ mol per 1 mol of silver to prepare a coating solution.

TABLE 5

| Composition of the green-sensitive layer | |
|---|---|
| Main component | Amount used |
| Emulsion A, B, C, D, 4 and 5 | Silver amount 0.39 g/m$^2$ |
| Gelatin | 1.56 g/m$^2$ |
| Magenta coupler (e) | $4.6\times10^{-4}$ mol/m$^2$ |
| Dye image stabilizer (f) | 0.14 g/m$^2$ |
| Solvent (g) | 0.42 g/m$^2$ |

*Nucleation-promoting agent
(Exemplification compound A-32)

Green-sensitive dye

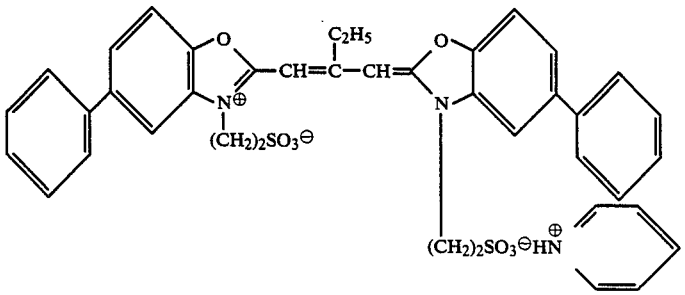

Irradiation-preventing dye for the green-sensitive emulsion layer

TABLE 5-continued
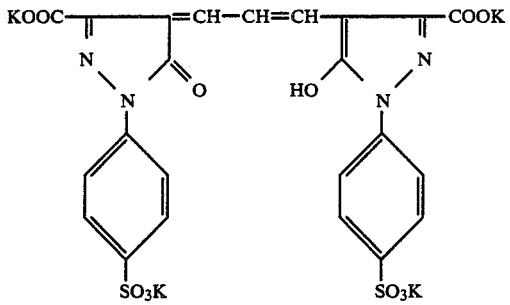
(e)
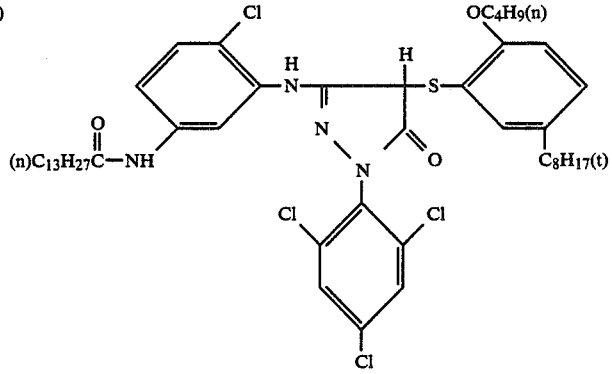
(f) The mixture of
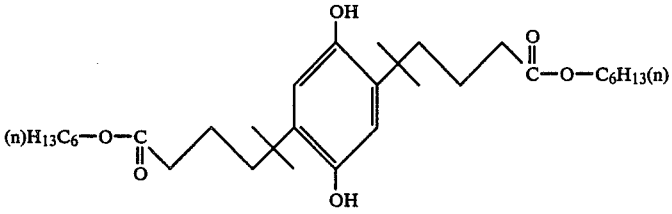
and
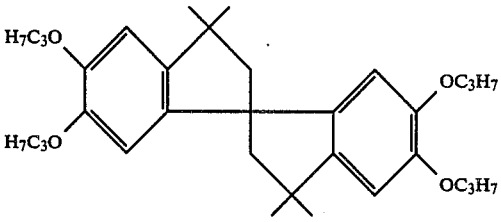
in the ratio of 1:1.5 (weight ratio)
(g) The mixture of
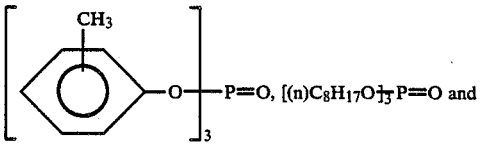
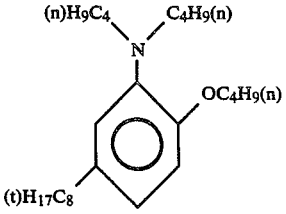

TABLE 5-continued in the ratio of 1:2:2 (weight ratio)

The thus prepared coating solution was applied onto a paper support, both surfaces of which had been laminated with polyethylene, to make a color photographic paper.

(3)

Exposure and development process

The color photographic papers prepared according to the above manner were respectively exposed to light through an optical wedge (1/10 seconds, 10 CMS) and a green filter (SP-2 manufactured and sold by Fuji Photo Film Co., Ltd.), and then subjected to the process step A (The pH of the color developing solution was 10.2), B (The pH of the color developing solution was 11.2) or C (The pH of the color developing solution was 12.0).

| Process step A | Time | Temperature |
|---|---|---|
| Color development | 3 minutes 30 seconds | 38° C. |
| Bleach-fixing | 1 minutes 30 seconds | 38° C. |
| Stabilization | | |
| (1) | 1 minute | 38° C. |
| (2) | 1 minute | 38° C. |
| (3) | 1 minute | 38° C. |

The stabilizing process was carried out according to the so-called counterflow replenishment method, in which the replenisher was first introduced to the stabilizing bath (3), the overflowed solution from the stabilizing bath (3) was introduced to the stabilizing bath (2), and the overflowed solution from the stabilizing bath (2) was introduced to the stabilizing bath (1).

| (Color developing solution) | Mother liquor |
|---|---|
| Diethylenetriaminepentaacetic acid | 2.0 g |
| Benzyl alcohol | 12.8 g |
| Diethylene glycol | 3.4 g |
| Sodium sulfite | 2.0 g |
| Sodium bromide | 0.26 g |
| Hydroxylamine sulfate | 2.60 g |
| Sodium chloride | 3.20 g |
| 3-Methyl-4-amino-N—ethyl-N—(β-methanesulfonamidoethyl) aniline | 4.25 g |
| Potassium carbonate | 30.0 g |
| Fluorescent whitener (stilbene type) | 1.0 g |
| With addition of water | 1000 ml |
| pH | 10.20 |

pH was adjusted with potassium hydroxide or hydrochloric acid.

| (Bleach-fixing solution) | Mother liquor |
|---|---|
| Ammonium thiosulfate | 110 g |
| Sodium hydrogen sulfite | 10 g |
| Iron (III) ammonium diethylenetriamine-pentaacetate monohydrate | 56 g |
| Disodium ethylenediaminetetraacetate dihydrate | 5 g |
| 2-Mercapto-1,3,4-triazole | 0.5 g |
| With the addition of water | 1000 ml |
| pH | 6.5 |

pH was adjusted with ammonia water or hydrochloric acid.

| (Stabilizing solution) | Mother liquor |
|---|---|
| 1-Hydroxyethylidene-1,1'-diphosphonic acid (60%) | 1.6 ml |
| Bismuth chloride | 0.35 g |
| Polyvinylpyrrolidone | 0.25 g |
| Ammonia water | 2.5 ml |
| Nitrilotriacetic acid | 1.0 g |
| 5-Chloro-2-methyl-4-isothiazolin-3-one | 50 mg |
| 2-Octyl-4-isothiazolin-3-one | 50 mg |
| Fluorescent whitener (4,4'-diaminostilbene type) | 1.0 g |
| With the addition of water | 1000 ml |
| pH | 7.5 |

pH was adjusted with potassium hydroxide or hydrochloric acid.

Process step B was the same as the process step A except that color development time was one minute 30 seconds and the pH of the developing solution was adjusted to 11.2.

Further, process step C is the same as the process step B except that the pH of the color developing solution was adjusted to 12.0.

(4)

Evaluation

Formed magenta image density of each direct positive image thus obtained was measured. The results are shown in Table 6.

TABLE 6

| Example No. | Emulsion | Process step A $D_{max}$ | Process step A $D_{min}$ | Process Step B $D_{max}$ | Process Step B $D_{min}$ | Process step C $D_{max}$ | Process step C $D_{min}$ |
|---|---|---|---|---|---|---|---|
| Example | | | | | | | |
| 4 | G | 2.5 | 0.10 | 2.6 | 0.11 | 2.3 | 0.13 |
| 5 | H | 2.4 | 0.11 | 2.6 | 0.12 | 2.3 | 0.13 |
| 6 | I | 2.3 | 0.11 | 2.5 | 0.12 | 2.2 | 0.13 |
| 7 | J | 2.0 | 0.12 | 2.1 | 0.12 | 2.1 | 0.12 |
| Comparative example | | | | | | | |
| 1 | 4 | 1.5 | 0.10 | 1.6 | 0.11 | 2.1 | 0.12 |
| 2 | 5 | 1.5 | 0.10 | 1.6 | 0.11 | 2.1 | 0.12 |

As apparent from Table 6, in the samples (Examples 4 to 7) where the core/shell emulsions G to J of the present invention were used, maximum magenta color density ($D_{max}$) obtained by the process step A or B using the color developing solution of pH 11.5 or less is unexpectedly higher than that obtained by the process step C using the color developing solution of pH 12.0, and the minimum density of Examples 4 to 7 is low. On the other hand, in the samples (Comparative examples 1 and 2) where the emulsions 4 and 5 were used, $D_{max}$ obtained by the process step A or B is markedly lower than $D_{max}$ obtained by the process step C, which means that Comparative examples are of no practical use under pH 12.

EXAMPLES 8 AND 9 AND COMPARATIVE EXAMPLES 3 AND 4

(a)

Preparation of emulsions (1) Emulsions K, 6 and 7

First, 30 g of gelatin was added to 1 l of a mixture containing 0.5 mol/l KBa, 0.2 mol/l NaCl and 0.0015 mol/l KI to make a solution. Then, 700 cc of 1 mol/l silver nitrate was added to the solution at 60° C. over a period of 20 minutes, and the mixture was allowed to stand to conduct physical ripening. The water soluble halides were removed therefrom with water washing, 20 g of gelatin was added to the residue, and the total volume of the mixture was adjusted to 1200 cc with water, to obtain silver halide emulsion 6 containing silver halide grains having an average grain size of 0.4 μm.

Then, 500 cc of a 1 mol/l aqueous silver nitrate solution and 500 cc of a 1.1 mol/l aqueous sodium chloride solution were simultaneously added to 300 cc of the emulsion 6 at 66° C. to precipitate silver chloride shell. The mixture was washed with water to obtain the silver halide core/shell emulsion K containing silver halide grains having an average grain size of 0.7 μm.

Separately, 500 cc of a 1 mol/l aqueous silver nitrate solution and 500 cc of a 1 mol/l aqueous potassium bromide solution were simultaneously added to 300 cc of the core emulsion 6 at 66° C. to precipitate silver bromide shell. The mixture was washed with water to obtain the silver halide core/shell emulsion 7 containing silver halide grains having an average grain size of 0.7 μm.

(2) Emulsions L and 8

First, 175 ml of a 2 mol/l aqueous silver nitrate solution and 175 ml of a 2.1 mol/l aqueous sodium chloride solution were simultaneously added to a solution containing 10 g of gelatin over a period of 10 minutes while the temperature of the gelatin solution was maintained at 60° C., and the mixture was allowed to stand for 15 minutes to conduct physical ripening. Then, 200 ml of a 2 mol/l aqueous potassium bromide solution was added to the mixture, and the mixture was allowed to stand for 15 minutes to conduct further physical ripening. The mixture was washed with water to remove the water soluble halides. Then, 10 g of gelatin was added to the residue, and water was added to the mixture to make the total volume to 300 ml, to obtain a silver bromochloride emulsion (Emulsion 8) containing silver bromochloride grains having an average grain size of 0.3 μm (The silver bromide content in the silver bromochloride was determined as 94 mol% according to a composition analysis).

A core/shell emulsion was prepared as follows using the emulsion 8 as core. That is, 100 ml of a 2 mol/l silver nitrate solution and 100 ml of a 2.1 mol/l potassium chloride solution were simultaneously added to 500 ml of the core emulsion (Emulsion 8) at 60° C. over a period of 5 minutes to precipitate silver chloride shell. The mixture was washed with water to obtain the core/shell emulsion L containing silver halide grains having an average grain size of 0.35 μm and containing 41 mol% of silver chloride shell based on the total silver halide amount.

(2)

Making of a color photographic paper

A panchromatic multilayer photographic paper having the layer construction shown in Table 7 was by applying the coating solution containing the internal latent image emulsion K, L, 7 or 8, which was respectively prepared according to the hereinafter described manners on a paper support, both faces had been laminated with polyethylene.

Preparation of the first layer coating solution: 10 ml of ethyl acetate and 4 ml of the solvent (c) were added to 10 g of the cyan coupler (a) and 2.3 g of the dye image stabilizer (b) to make a solution, which was then emulsified and dispersed in 90 ml of a 10% aqueous gelatin solution containing 5 ml of 10% sodium dodecylbenzen sulfonate solution. Separately, the red-sensitive dye shown below was respectively added to the aforementioned silver halide emulsions K, L, 7 and 8 (respectively containing 70 g of Ag per kg) in an amount of $2.0\times10^{-4}$ mol per 1 mol of silver halide to obtain each 90 g of a red-sensitive emulsion. The emulsified dispersion and the emulsion were mixed to make a solution, and the concentration of the solution was adjusted with gelatin so as to make the composition shown in Table 7. Then, the nucleating agent, i.e. the compound 9 and the nucleation-promoting agent, i.e. the compound A-21 respectively in an amount of $4.0\times10^{-5}$ mol and $3.0\times10^{-4}$ mol per 1 mol of Ag were added to the solution to prepare the coating solution for the first layer.

The coating solutions for the second to the seventh layers were prepared in the same manner as that for the coating solution for the first layer. As a gelatin hardening agent for each layer was used 1-oxy-3,5-dichloro-s-triazine sodium salt.

TABLE 7

| Layer | Main component | Amount used |
|---|---|---|
| The 7th layer (Protective layer) | Gelatin | 1.33 g/m$^2$ |
| | Acryl modified copolymer of polyvinyl alcohol (Modification degree 17%) | 0.17 g/m$^2$ |
| The 6th layer (UV absorbing layer) | Gelatin | 0.54 g/m$^2$ |
| | UV absorbent (h) | $5.10\times10^{-4}$ mol/m$^2$ |
| | Solvent (j) | 0.08 g/m$^2$ |
| The 5th layer (Blue-sensitive layer) | Emulsion H silver: | 0.40 g/m$^2$ |
| | Gelatin | 1.35 g/m$^2$ |
| | Yellow coupler (k) | $6.91\times10^{-4}$ mol/m$^2$ |
| | Dye image stabilizer (l) | 0.13 g/m$^2$ |
| | Solvent (m) | 0.02 g/m$^2$ |
| | Nucleating agent and Nucleation-promoting agent | |
| The 4th layer (UV absorbing layer) | Gelatin | 1.60 g/m$^2$ |
| | Colloidal silver | 0.10 g/m$^2$ |
| | UV absorbent (h) | $1.70\times10^{-4}$ mol/m$^2$ |
| | Color mixing inhibitor (i) | $1.60\times10^{-4}$ mol/m$^2$ |
| | Solvent (j) | 0.24 g/m$^2$ |
| The 3rd layer (Green-sensitive layer) | Emulsion H silver: | 0.39 g/m$^2$ |
| | Gelatin | 1.56 g/m$^2$ |
| | Magenta coupler (e) | $4.60\times10^{-4}$ mol/m$^2$ |
| | Dye image stabilizer (f) | 0.14 g/m$^2$ |
| | Solvent (g) | 0.42 g/m$^2$ |
| The 2nd layer (Color mixing - inhibiting layer) | Gelatin | 0.90 g/m$^2$ |
| | Color mixing inhibitor (d) | $2.33\times10^{-4}$ mol/m$^2$ |
| The 1st layer | Emulsion H silver: | 0.39 g/m$^2$ |

TABLE 7-continued

| Layer | Main component | Amount used |
|---|---|---|
| (Red-sensitive layer) | Gelatin | 0.90 g/m$^2$ |
| | Cyan coupler (a) | 7.05 × 10$^{-4}$ mol/m$^2$ |
| | Dye image stabilizer (b) | 5.20 × 10$^{-4}$ mol/m$^2$ |
| | Solvent (c) | 0.22 g/m$^2$ |
| Support | Polyethylene laminated paper (white pigment ($TiO_2$, etc.) and bluish dye (ultramarine, etc.) are contained in the polyethyle in the first layer side) | |

The magenta coupler (e), the dye image stabilizer (f) and the solvent (g) used in the aforesaid third layer; the green-sensitive sensitizing dye and the irradiation-preventing dye were the same as those disclosed in Example 4. Other additives are as follows.

Blue-sensitive emulsion layer;

-continued

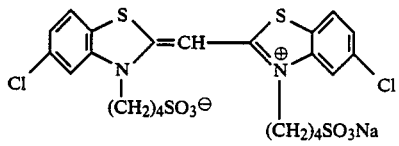

Red-sensitive emulsion layer;

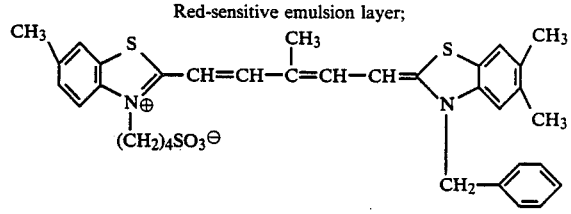

The following dye was used as a irradiation-preventing dye for the red-sensitive emulsion layer.

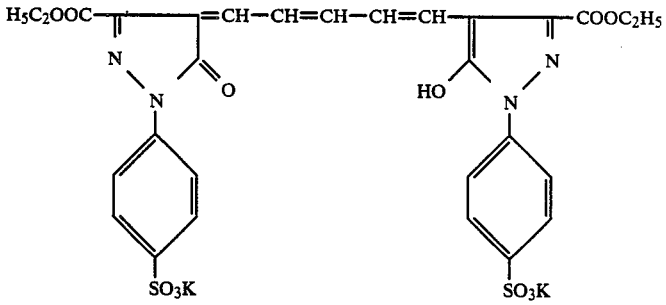

The chemical structures of the compounds such as a coupler used in the present examples are as follows.

Yellow coupler (k)

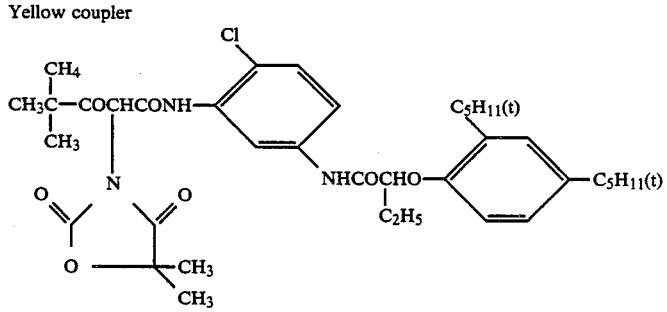

Dye image stabilizer (l)

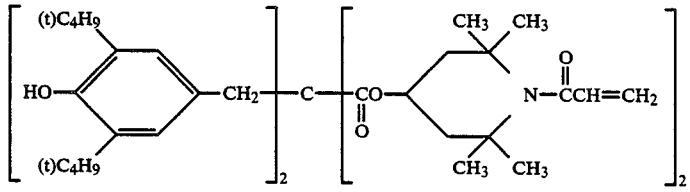

Solvent (iso $C_9H_{19}O)_3P{=}O$ (m)

UV absorbent The mixture of (h)

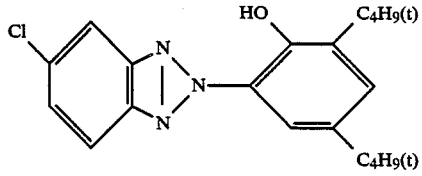

-continued
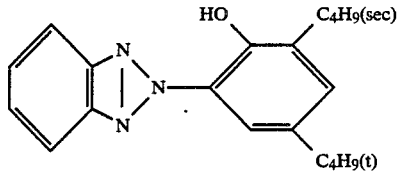
and
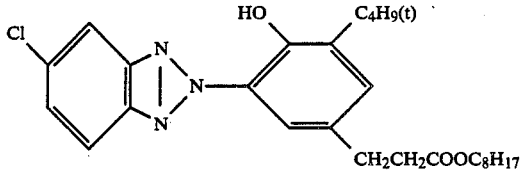
in the ratio of 1:5:3 (molar ratio)
Color mixing inhibitor (i)
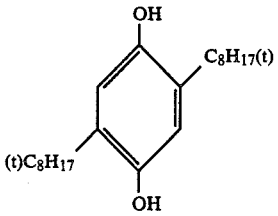
Solvent (iso $C_9H_{19}O)_3P{=}O$ (j)
Cyan coupler (a)
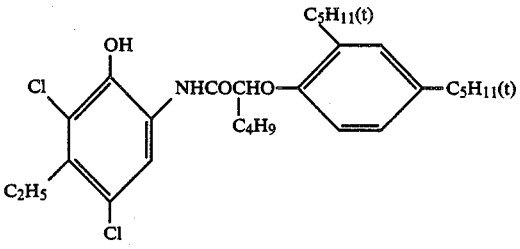
Dye image stabilizer (b)
The mixture of
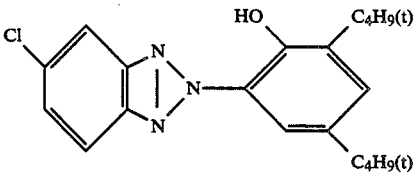
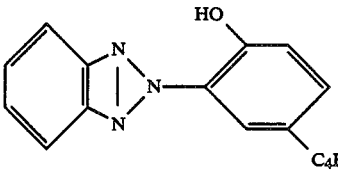
and
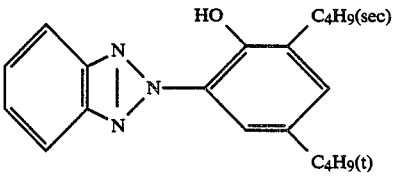
in the ratio of 1:3:3 (molar ratio)
Solvent (c)

-continued

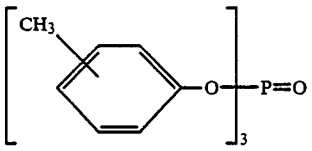

Color mixing inhibitor (d)

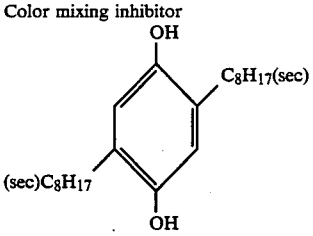

The coating solutions for the first layer to the seventh layer were adjusted in respective surface tension and viscosity balance, and simultaneously applied on the support to make a panchromatic multilayer photographic paper.

(3)

Exposure, Development and Evaluation

The thus obtained color photographic papers were respectively subjected to exposure to light and development processes under the same conditions as those in Example 4. The results obtained with respect to the formed magenta image are shown in Table 8.

TABLE 8

| Example No. | Emulsion | Process step A $D_{max}$ | Process step A $D_{min}$ | Process Step B $D_{max}$ | Process Step B $D_{min}$ | Process step C $D_{max}$ | Process step C $D_{min}$ |
|---|---|---|---|---|---|---|---|
| Example | | | | | | | |
| 8 | K | 2.7 | 0.12 | 2.7 | 0.12 | 2.7 | 0.12 |
| 9 | L | 2.6 | 0.12 | 2.6 | 0.12 | 2.6 | 0.12 |
| Comparative example | | | | | | | |
| 3 | 7 | 2.0 | 0.13 | 2.1 | 0.13 | 2.4 | 0.12 |
| 4 | 8 | 1.7 | 0.11 | 1.8 | 0.12 | 2.3 | 0.12 |

As apparent from the results of Table 8, the effects similar to those obtained in Example 4 are obtained in the series of the panchromatic multilayer photographic papers containing the red-sensitive emulsion layer, the green-sensitive emulsion layer and the blue-sensitive emulsion layer.

Further, when the surface of the sample of the comparative example 3 was rubbed, the rubbed areas were desensitized to form streaks.

EXAMPLES 10 TO 13 AND COMPARATIVE EXAMPLES 5 AND 6

Samples were made in the same manner as in Example 9 except that the emulsion shown in Table 9 was used, and neither nucleating agent nor nucleation-promoting agent was used in the emulsion layers.

The following processes were applied to these samples (1-Acetyl-2-phenylhydrazine was added to the developing solution as a nucleating agent).

| Process step (30° C.) | Process time |
|---|---|
| Color development | 3 minutes 30 seconds |
| First water washing | 1 minute |
| Bleach-fixing | 1 minute 30 seconds |

-continued

| Second water washing | 1 minute |
|---|---|
| Color developing solution - (1) | |
| 4-Amino-3-methyl-N—ethyl-N—(β-methanesulfonamidoethyl) aniline sulfate | 5 g |
| Sodium sulfite (anhydrous) | 2 g |
| Trisodium phosphate | 40 g |
| 1-Acetyl-2-phenylhydrazine (Nucleating agent) | 1 g |
| With addition of water (pH was adjusted to 12.0 with sodium hydroxide) | 1 l |
| Color developing solution - (2) | |
| The same as Color developing solution - (1) except that pH was adjusted to 11.3. | |
| Bleach-fixing solution | |
| Iron (III) ammonium ethylenediamine-tetraacetate dihydrate | 40 g |
| Ethylenediaminetetraacetic acid | 3 g |
| Ammonium thiosulfate (70% aqueous solution) | 100 ml |
| Ammonium sulfite (40% aqueous solution) | 27.5 ml |
| With addition of water (pH was adjusted to 7.10 with potassium hydroxide or glacial acetic acid) | 1 l |

Cyan density was measured. The results are shown in Table 9.

TABLE 9

| Example No. | Emulsion | Color development $D_{max}$ | Color development $D_{min}$ | Process step (2) $D_{max}$ | Process step (2) $D_{min}$ |
|---|---|---|---|---|---|
| Example | | | | | |
| 10 | G | 2.5 | 0.11 | 0.15 | 0.09 |
| 11 | H | 2.6 | 0.11 | 0.15 | 0.09 |
| 12 | I | 2.5 | 0.11 | 0.14 | 0.09 |
| 13 | J | 2.4 | 0.11 | 0.15 | 0.09 |
| Comparative example | | | | | |
| 5 | 4 | 2.3 | 0.11 | 0.15 | 0.09 |
| 6 | 5 | 2.2 | 0.11 | 0.15 | 0.09 |

There was no difference in $D_{max}$ between the emulsions G to J of the present invention and the comparative examples 4 and 5 using a silver halide emulsion where AgCl is not contained in the shell.

From the foregoing, it will be understood that various advantages were brought about by the present invention.

Especially in Process I, the lowering of color density is small even when processing is conducted in a shortened time and using a color developing solution which does not substantially contain benzyl alcohol. Further, since a color developing solution does not substantially contain benzyl alcohol, the load for environmental pollution countermeasures for the waste water is small. Furthermore, washing off of the developing solution may be easily conducted and benzyl alcohol does not remain in the light-sensitive material, and as a result the lowering of image preservability caused by the remaining of benzyl alcohol is not observed and processing time is shortened.

Further, especially according to Process II, a direct positive color image having a high maximum color density and a low minimum image density may be promptly and constantly obtained by processing an unfogged internal latent image type silver halide light-sensitive material in the presence of a particular nucleating agent using a color developing solution of a low pH.

Finally, the developing solution used is stable to air oxidation and can give a direct positive color image of good quality for a long period of time.

What is claimed is:

1. A method for forming a direct positive color image which comprises (i) image-wise exposing to light a light-sensitive material comprising a support having provided thereon at least one photographic emulsion layer containing unfogged internal latent image type silver halide grains and a color image-forming coupler; (ii) developing the light-sensitive material with a surface developing solution containing an aromatic primary amine type color developing agent in the presence of a nucleating agent and/or fogging exposure; and (iii) bleaching and fixing the resulting material to form the direct positive color image, wherein the pH of the developing solution is 11.5 or less; the color coupler itself is a substantially non-diffusible compound which forms or releases a substantially non-diffusible dye by oxidation coupling with an aromatic primary amine type color developing agent; and the internal latent image type silver halide grains have a core/shell built-up structure wherein the core is composed of silver bromide, silver bromoiodide, silver bromochloride or silver bromochloroiodide, which contains 90 mol% or more of silver bromide and 10 mol% or less of silver iodide, and the shell is composed of silver bromochloride or silver chloride, which contains 20 mol% or more of silver chloride.

2. A method of claim 1, wherein the developing solution does not substantially contain benzyl alcohol and the shell is composed of silver bromochloride which contains 20 mol% or more of silver chloride.

3. A method of claim 2, wherein the aromatic primary amine type color developing agent is a p-phenylenediamine type color developing agent.

4. A method of claim 2, wherein the average grain size of the unfogged internal latent image type silver halide grains is 0.2 to 1.5$\mu$.

5. A method of claim 4, wherein 90% or more of the total grains are fallen within ±40% of the average grain size.

6. A method of claim 2, wherein the development is conducted in the presence of a nucleating agent which comprises at least one compound selected from the group consisting of the compounds represented by the following general formula (I) or (II):

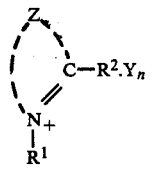

General formula (I)

wherein, Z represents nonmetal atoms necessary for forming a 5- or 6-membered heterocyclic ring which may contain a substituent; $R^1$ is an aliphatic group; $R^2$ is a hydrogen atom, an aliphatic group or an aryl group; $R^1$ and $R^2$ may contain a substituent provided that at least one of $R^1$, $R^2$ and Z groups contain an alkynyl group, an acyl group, a hydrazine group or a hydrazone group, or $R^1$ and $R^2$ are combined to form dihydropyridinium skeleton as a 6-membered ring; at least one of $R^1$, $R^2$ and Z substituents may contain $X^1(L^1)_{m1}$ wherein $X^1$ is a group for promoting adsorption on silver halide and $L^1$ is a bivalent linking gorup; Y is a counter ion for electrical charge balance; and n is 0 or 1; and $m^1$ is 0 or 1;

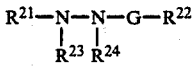

General formula (II)

wherein, $R^{21}$ represents an aliphatic group; an aromatic group or a heterocyclic group; $R^{22}$ represents a hydrogen atom, an alkyl group, an aralkyl group, an aryl group, an alkoxy group, an aryloxy group or an amino group; G represents a carbonyl group, a sulfonyl group, a sulfoxy group, a phosphoryl group or an iminomethylene group (NH=C<); $R^{23}$ and $R^{24}$ and both hydrogen atoms, or one of them represents a hydrogen atom and the other represents any one of an alkylsulfonyl group, an arylsulfonyl group or an acyl group, or G, $R^{23}$, $R^{24}$ and hydrazine nitrogen may form together a hydrazone structure (>N—N=C<).

7. A method of claim 6, wherein the nucleating agent is contained in the light-sensitive material or a processing solution of the light-sensitive material.

8. A method of claim 7, wherein the nucleating agent is contained in the light-sensitive material in an amount of $10^{-8}$ to $10^{-2}$ mole per 1 mole of the silver halide.

9. A method of claim 2, wherein the fogging exposure is conducted before and/or during the developing process, and after the image-wise exposure.

10. A method of claim 2, wherein a nucleation-promoting agent represented by the following general formula (III) or (IV) is contained in the light-sensitive material or a processing solution of the light-sensitive material:

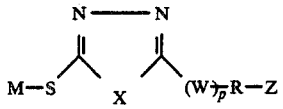

General formula (III)

wherein M represents a hydrogen atom, an alkali metal atom, an ammonium group or a group cleaving in an alkaline condition; X represents an oxygen atoms, a sulfur atom or a selenium atom; W represents —S—,

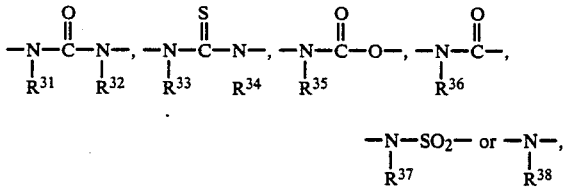

$R^{31}$, $R^{32}$, $R^{33}$, $R^{34}$, $R^{35}$, $R^{36}$, $R^{37}$ and $R^{38}$ may be the same or different and independently represent a hydrogen atom, substituted or unsubstituted alkyl group, an aryl group, a alkenyl group or an aralkyl group; R represents a straight-chain or branched alkylene group, or an arylene group; Z represents a hydrogen atom, a halogen atom, a nitro group, a cyano group, a substituted or unsubstituted amino group, a quaternary ammonium group, an alkoxy group, an acryloxy group, an alkylthio group, an arylthio group, a heterocyclic oxy group, a heterocyclic thio group, a sulfonyl group, a carbamoyl group, a sulfamoyl group, a carbonamido group, a sulfonamido group, an acyloxy group, a sulfonyloxy group, an ureido group, a thioureido group, an acyl group, a heterocyclic group, an oxycarbonyl group, an oxysulfonyl group, an oxycarbonylamino group or a mercapto group; and p represents 0 or 1;

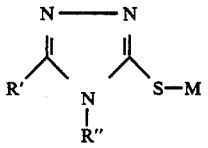

General formula (IV)

wherein R′ is a hydrogen atom, a halogen atom, a nitro group, a mercapto group, an amino group, or a group $(W)_pR$-Z; R″ represents a hydrogen atom, an amino group or a group $(w')_qR$-Z; w′ represents

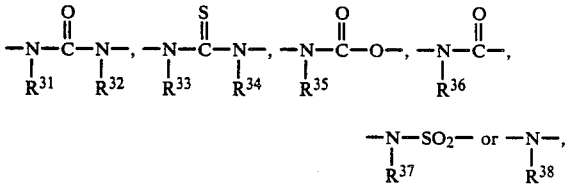

q represents 0 or 1; and M, R, Z, W, p, $R^{31}$, $R^{32}$, $R^{33}$, $R^{34}$, $R^{35}$, $R^{36}$, $R^{37}$ and $R^{38}$ have the same meaning as individuals described in the above general formula (III), respectively.

11. A method of claim 10, wherein the nucleation-promoting agent is contained in the light-sensitive material in an amount of $10^{-6}$ to $10^{-2}$ mol per 1 mol of the silver halide.

12. A method of claim 1, wherein the pH of the developing solution is 9.5 to 11.3.

13. A method of claim 12, wherein the pH of the developing solution is 9.8 to 10.9.

14. A method of claim 1, wherein the light-sensitive material comprises a blue-sensitive silver halide emulsion layer, a green-sensitive silver halide emulsion layer and a red-sensitive silver halide emulsion layer.

15. A method of claim 14, wherein the blue-sensitive silver halide emulsion layer contains at least one naphthol or phenol type yellow dye-forming coupler, the green-sensitive silver halide emulsion layer contains at least one pyrazolone or pyrazoloazole type magenta dye-forming coupler and the red-sensitive silver halide emulsion layer contains at least one open-chained or heterocyclic ketomethylene type cyan dye-forming coupler.

* * * * *